US005931623A

United States Patent [19]

Hastings et al.

[11] Patent Number: 5,931,623

[45] **Date of Patent: *Aug. 3, 1999**

[54] SPIRAL BINDING METHOD AND APPARATUS

[75] Inventors: Mark E. Hastings; Randy C. Peterson; Kevin L. Engelbert, all of Mukilteo; John H. Mar, Seattle, all of Wash.

[73] Assignee: Unicoil, Inc., Norcross, Ga.

[ * ] Notice: This patent is subject to a terminal disclaimer.

[21] Appl. No.: 08/728,623

[22] Filed: Oct. 10, 1996

Related U.S. Application Data

[63] Continuation-in-part of application No. 08/539,848, Oct. 6, 1995, Pat. No. 5,695,308, which is a continuation-in-part of application No. 08/320,283, Oct. 11, 1994, Pat. No. 5,584, 632.

[51] Int. Cl.[6] ..... B42B 5/10

[52] U.S. Cl. ..... 412/39; 412/38

[58] Field of Search ..... 412/38, 39, 40, 412/42, 9

[56] References Cited

U.S. PATENT DOCUMENTS

| | | | |
|---|---|---|---|
| 3,122,761 | 3/1964 | Bouvier . | |
| 3,367,649 | 2/1968 | Thomas et al. . | |
| 3,459,242 | 8/1969 | Schmidt . | |
| 3,467,150 | 9/1969 | Ostermeier . | |
| 3,486,537 | 12/1969 | Sickinger . | |
| 3,592,242 | 7/1971 | Sickinger . | |
| 3,793,660 | 2/1974 | Sims et al. . | |
| 3,818,954 | 6/1974 | Pfaffle . | |
| 3,826,290 | 7/1974 | Pfaffle . | |
| 3,889,309 | 6/1975 | Adams et al. . | |
| 3,924,664 | 12/1975 | Pfaffle . | |
| 3,967,336 | 7/1976 | Cutter . | |
| 3,972,109 | 8/1976 | Sickinger . | |
| 4,129,156 | 12/1978 | Pfaffle . | |
| 4,129,913 | 12/1978 | Pfaffle . | |
| 4,143,686 | 3/1979 | Sickinger et al. . | |
| 4,185,668 | 1/1980 | Harbert . | |
| 4,208,750 | 6/1980 | Pfaffle . | |
| 4,249,278 | 2/1981 | Pfaffle . | |
| 4,378,822 | 4/1983 | Morris . | |
| 5,584,632 | 12/1996 | Stiles et al. | 412/39 |
| 5,695,308 | 12/1997 | Hastings et al. | 412/39 |

FOREIGN PATENT DOCUMENTS

| | | |
|---|---|---|
| 717238 | 9/1965 | Canada . |

*Primary Examiner*—Willmon Fridie, Jr.

*Attorney, Agent, or Firm*—Christensen O'Connor Johnson & Kindness PLLC

[57] ABSTRACT

An apparatus for spiral binding a stack of papers together as a unit. The apparatus includes a coil feeder for feeding a spiral coil into the holes in the stack of papers, a pin extension and retraction mechanism, a coil cutter mechanism, and a paper thickness measuring and sizing mechanism. The spiral binding unit includes an aperture through which a spiral coil is inserted between a feed shaft and a rotatably mounted roller. The roller may be rotated in a pulsed manner. As the coil is inserted, the roller pushes the spiral coil into contact with the feed shaft. As the roller rotates, the coil is guided around a plurality of spiral guides that cause the coil to spiral into the holes in the stack of paper. The guides and any other surfaces which the end of the coil contacts along its path may have chamfered edges. The pin extension and retraction mechanism includes a plurality of curved locator pins that are movable between an extended and a retracted position. In the extended position, the pins extend up through the holes in the stack of papers. The paper thickness and sizing mechanism measures the thickness and width of the stack of papers. This information is used to provide the operator an indication of the proper coil size to use. This information is also used by the coil cutter to cut the coil to the proper length.

33 Claims, 14 Drawing Sheets

SPIRAL BINDING METHOD AND APPARATUS

This is a continuation in part of the prior application Ser. No. 08/539,848, filed on Oct. 6, 1995, now U.S. Pat. No. 5,695,308 which is a continuation in part of application Ser. No. 08/320,283, filed on Oct. 11, 1994, now U.S. Pat. No. 5,584,632 the benefit of the filing date of which is hereby claimed under 35 U.S.C. § 120.

FIELD OF THE INVENTION

The invention relates generally to methods and apparatus for binding sheets of paper or other materials together, more specifically, the invention relates to the spiral binding of sheets of paper or other flat stock materials.

BACKGROUND OF THE INVENTION

Many methods of binding sheets of paper or other flat stock materials together as a unit have been developed in the past, including book binding, Velobinding®, spiral binding, etc. Each method has its own advantages and disadvantages. Classic book binding, although preferred in many applications, requires equipment and manufacturing techniques that generally do not lend themselves to low volume binding, such as that required in small companies, offices, print shops, etc. Velobinding may be performed with equipment readily available to small offices or print shops. The bound unit produced by Velobinding requires a large margin on the left-hand side and does not allow the resulting unit to be easily laid open for viewing.

Spiral binding allows a stack of papers to be bound together as a unit that is easily opened to any page, thus making it very acceptable in the marketplace. However, in the past the equipment required to spiral bind a stack of papers has not lent itself to application in small businesses, offices, print shops, etc., due to the expense and complexity of the binding equipment.

In spiral binding, a series of equally-spaced holes are punched in one edge of the stack of papers. A continuous spiral coil is then fed or spiraled through the holes to form a bound unit. Spiral binding has been a preferred method of binding for many years and a number of manufacturers sell equipment to perform spiral binding.

Typically, a pre-wound spiral coil is placed around an appropriately sized mandrel or a coil is wound over the mandrel. The stack of papers to be bound together is first punched along one edge and then positioned near the end of the mandrel. A roller is moved into contact with the outer surface of the spiral coil, pressing the inner surface of the coil against the mandrel. The free end of the spiral coil extending out from one end of the mandrel is manually placed within the first hole in the stack of papers. The roller is then rotated, causing the coil to rotate. As the roller rotates, the coil spirals into the holes in the stack of papers, binding them together as a unit. Exemplary prior art equipment used to perform spiral binding is disclosed in U.S. Pat. No. 4,378,822, issued to Morris and U.S. Pat. No. 4,249,278 issued to Pfaffle.

Most prior spiral binding equipment is large, complex, and designed for use in assembly lines where commercially produced spiral bound units are manufactured. Some prior art equipment is manufactured for use in smaller applications, such as offices, small businesses, or print shops. However, such equipment is expensive, and difficult and time consuming to use. Typically, one piece of equipment is purchased to punch appropriately spaced holes in the stack of papers and a second piece of equipment is purchased to spiral a coil into the stack of punched paper. In spiral binding equipment, such as that disclosed in the Morris patent, an operator manually positions a punched stack of papers so that the holes are positioned in line with a coil placed over a mandrel. The operator then manually starts the end of the coil into the holes in the paper. As described above, the operator then switches on the equipment so that a roller presses the coil against the mandrel, spiraling the coil into the holes in the paper.

During spiraling, it is common for the coil to deform slightly causing it to miss the holes in the paper, resulting in the coil binding or spiraling off the edge of the paper. One of the contributors to coil deformation is the fact that the coil is driven from only one edge of the paper, thus creating greater stresses within the coil as it spirals further along the length of the paper. When the coil binds or spirals off the edge of the paper, the rotation of the roller and coil must be reversed and the coil spiraled backward until it moves back into position. The spiraling process is then repeated until the coil spirals through all of the holes over the length of the stack of papers being bound.

If stacks of different thicknesses are to be bound together as a unit, the operator must maintain different size mandrels on hand. In order to use different size coils, it is necessary for the operator to exchange the mandrels in the apparatus to correspond with the size coil that is being used.

In other spiral binding equipment, the coil is started into the holes at one end of the stack of papers manually. The portion of the coil spiraled into the stack of papers is then pressed against two parallel, rotating rollers that extend along the edge of the stack of papers. As the coil is pressed against the moving rollers, the rollers contact the coil and spiral it into the holes in the paper. This type of spiral binding equipment also deforms the coil, causing it to miss holes in the stack of paper. Thus, an operator must reverse the rotation of the coil, reposition the coil and restart the operation.

Past spiral binding equipment is bulky, difficult to use, expensive, and poorly esthetically designed. In addition, prior spiral binding equipment has a number of moving parts. As with any equipment with moving parts, safety concerns are always an issue.

As can be seen from above, there is a need for improved methods and apparatus to spiral bind a stack of papers together as a unit. One goal of the present invention is to reduce some of the problems associated with prior apparatus and methods thus helping to meet this need.

SUMMARY OF THE INVENTION

The present invention is a spiral binder for inserting a spiral coil into a plurality of holes in a stack of papers in order to bind them together. In one embodiment of the invention, the apparatus includes a coil feeder for rotatably feeding a preformed coil into the holes in the stack of papers. The coil feeder includes a rotatably mounted roller, a drive motor to rotate the roller, a feed shaft radially spaced outward from the surface of the roller, and a plurality of guides extending radially outward from the surface of the feed shaft. The coil is fed onto the feed shaft between the feed shaft and the roller. The roller is biased toward the feed shaft in order to apply a force that presses the roller into the coil and the coil into the feed shaft. The guides are positioned on the feed shaft so that as the coil spirals around the guides, it is fed through the coil feeder.

In accordance with other aspects of the invention, the guides extend radially outward from the surface of the feed shaft at approximately the same pitch as the individual loops of the coil. The guides, and any other surfaces which the end of the coil comes in contact with, may be chamfered so as to help guide the end of the coil along its path as it travels through the coil feeder. The guides may be contained in a modular unit which can be slid into and out of the coil feeder for maintenance and other functions.

In accordance with yet other aspects of the invention, the roller may be operated in a pulsed manner, one implementation of which periodically provides the drive motor with an initial inertia which causes it to rotate an angular distance. The coil feeder also includes a sensor to detect when a coil is inserted into the coil feeder. When the sensor detects that a coil is present, a drive motor rotates the roller, thus feeding the coil into the holes in the stack of paper. The roller automatically starts the rotation of the roller upon insertion of the coil into the spiral binder. The coil feeder may also include sensors to detect when a coil that is too short to fully bind the stack of papers has been inserted into the coil feeder. The roller may be operated in reverse to spiral a coil that is too short back out of the stack of papers and the coil feeder.

In accordance with still other aspects of the invention, the coil feeder includes a mechanism for detecting when the coil has spiraled through the holes in the stack of papers. The mechanism also provides a coil cutter an indication of when to cut the coil to size. The coil cutter may have an extension and chamfered edges to help guide the end of the coil through the coil cutter. The spiral binder also includes a means for providing the operator an indication of the optimum coil size to be used in binding the stack of papers. The means for providing an operator an indication of coil size includes a paper hold down bar for pressing the stack of papers into contact with the binding platform during binding. The hold down bar may be adjusted to apply a force which is strong enough to hold the papers in place during binding but which is light enough to allow the papers to shift slightly so that the holes in the papers may become aligned according to the curvature of the coil as the coil spirals through the holes.

In accordance with other aspects of the invention, the coil binder includes a plurality of locator pins. The locator pins are extendible and retractable. When in an extended position, the locator pins extend through the holes in the stack of papers in order to locate the stack of papers in the proper position on the spiral binder. During binding, the locator pins retract out of the holes in the stack of papers in order to allow the coil to be spiraled through the holes. In some embodiments, the locator pins may be curved. The locator pins or the shafts which guide them may be mounted with floating mounts which allow them to shift slightly with the papers so that the locator pins may be more easily retracted from the holes in the shifted papers.

An embodiment of a method to perform the steps used in carrying out the present invention is also disclosed.

The present invention eliminates a number of the disadvantages associated with prior art spiral binding methods and apparatus. The coil feeder of the invention allows coils of varying diameters and filament sizes to be used. The invention also properly locates the stack of papers on the binding apparatus to ensure that the coil spirals properly through the holes in the stack of papers. The spiral binding apparatus of the present invention is easy to use, fast, and economical. In addition, the invention provides an operator indications of the proper coil diameter to be used and automatically cuts the coil to the proper length for the length of papers used.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
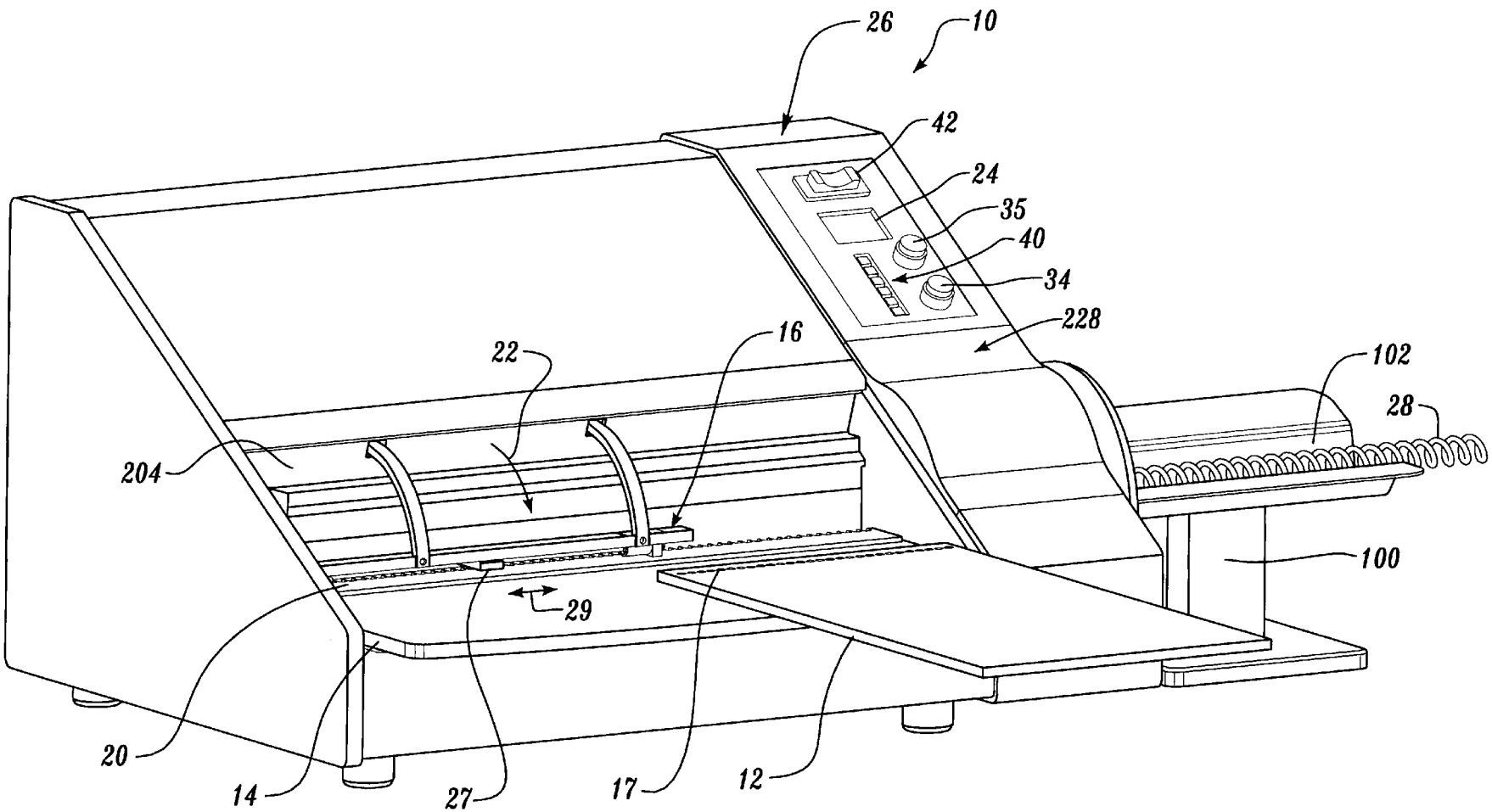
FIG. 1 is a perspective view of a spiral binding apparatus formed in accordance with the present invention.

A spiral binder 10 formed in accordance with the present invention is illustrated in FIG. 1. The overall operation of the spiral binder 10 is first discussed generally below and then the individual structure and operation of the binder is discussed in more detail. The spiral binder 10 is configured to be used with prepunched pages of paper or other flat stock materials. Such pages can be either purchased in a prepunched form or can be punched on location with one of several different punches that are readily commercially available. The punch punches a plurality of equally spaced holes 17 (FIG. 1) along one edge of the stack of papers 12.

Figure 10:
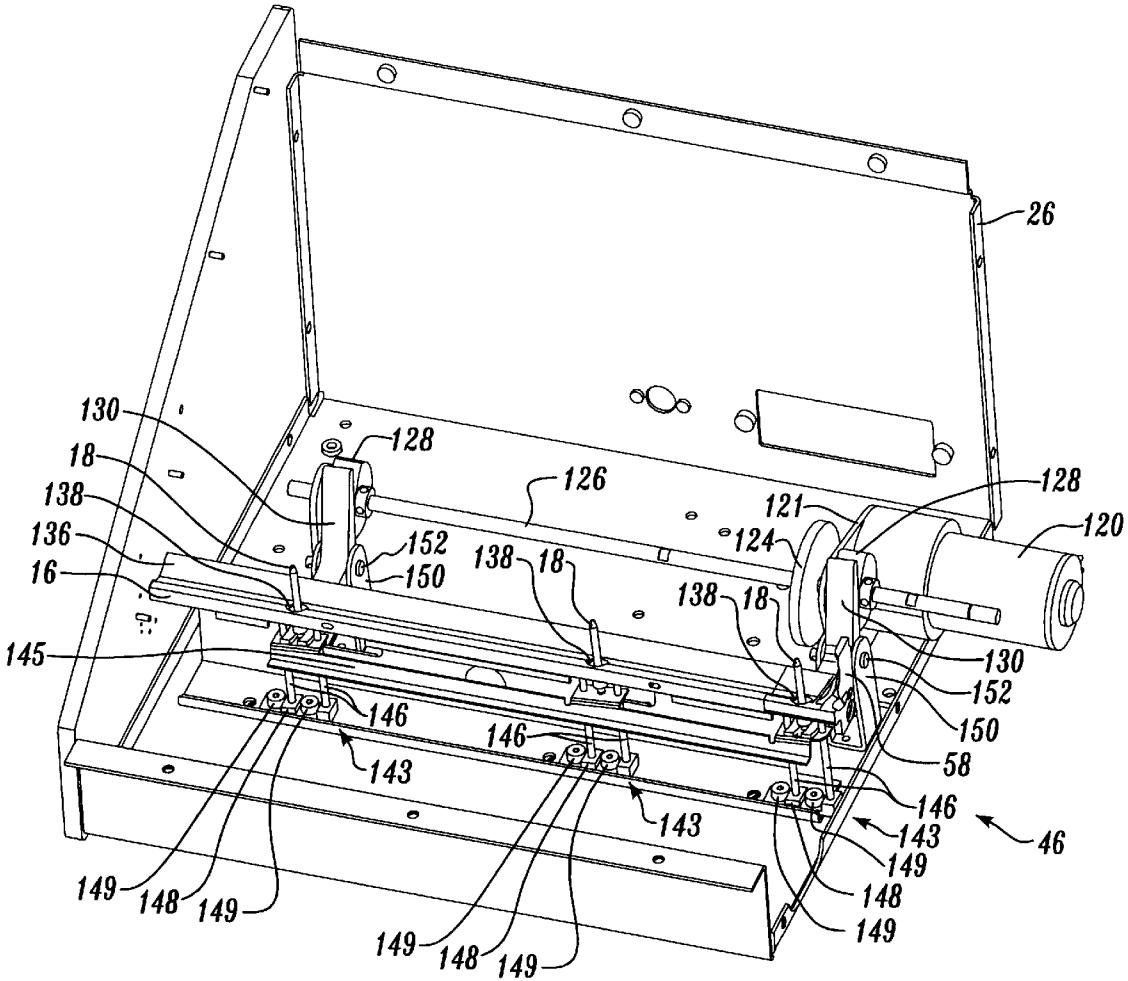
FIG. 10 is a perspective view of the pin extension/retraction mechanism.

Once punched, the stack of papers 12 is placed on the binding platform 14 (FIG. 1) so that the holes 17 in the stack of papers 12 are properly positioned over a guide plate 16 (FIGS. 1 and 10). In the preferred embodiment, a series of locator pins 18 (FIG. 10) extend through the guide plate 16 to assist the operator in properly locating the stack of papers 12. An operator places the stack of papers 12 over the guide plate 16 so that the locator pins pass through the holes 17 in the stack of papers. Once properly positioned, the operator depresses an advance button 34 or a foot pedal (FIG. 1) causing a paper hold down bar 20 (FIGS. 1 and 12–14) to move downward as indicated by arrow 22 (FIG. 1). The paper hold down bar 20 applies a force on the upper surface of the stack of papers 12 in the direction of the binding platform 14. This downward directed force helps to maintain the stack of papers 12 in position while binding. In addition to holding the stack of papers 12 in position, the paper hold down bar 20 also provides an indication of the thickness of the stack of papers 12. This indication of thickness is derived from an encoder and decoded by a controller or microprocessor (not shown) to suggest an optimum spiral coil 28 diameter to the operator on an indicator 24 on the front of the housing 26. The operator then selects the proper spiral coil 28 size based on the information provided on the indicator 24.

After the stack of papers 12 is properly positioned on the binding platform 14 and the paper hold down bar 20 is positioned on top of the stack of papers, the operator adjusts a paper sizing slide 27 located on the paper hold down bar 20. The operator moves the paper sizing slide 27 to the left or right as illustrated by arrow 29 in FIG. 1 until it is positioned over the last hole in the left edge of the stack of papers 12. Once positioned, during operation of the spiral binder 10, the paper sizing slide 27 provides an indication of when the spiral coil 28 has spiraled through all of the holes 17 in the stack of papers 12, as described below. This indication is used by a microprocessor in the spiral binder to determine when to stop feeding the spiral coil 28 into the stack of papers and when to cut the right end of the coil to size.

Figure 2:
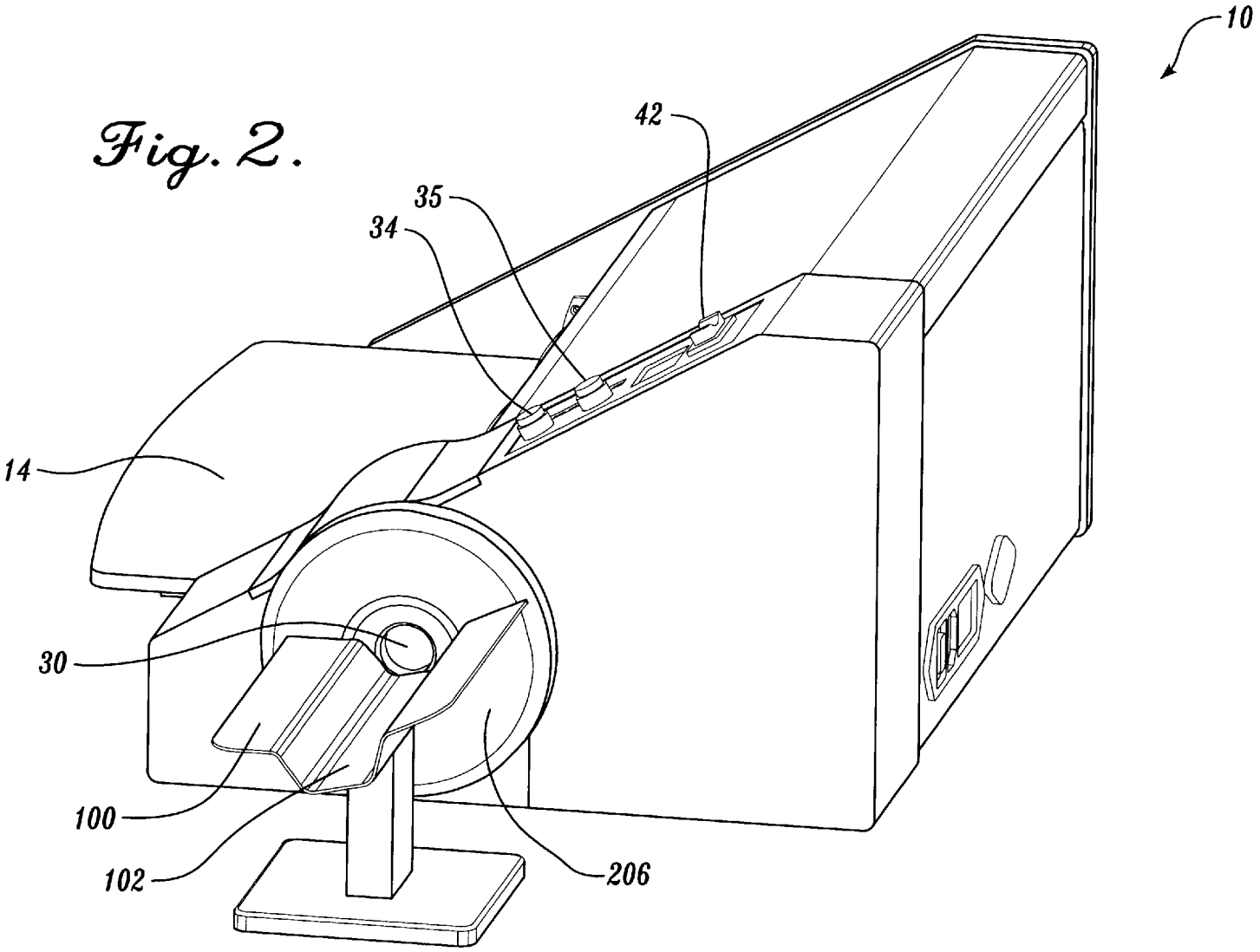
FIG. 2 is another perspective view of the spiral binding apparatus of FIG. 1.

After setting the paper sizing slide 27, the operator inserts a spiral coil 28 (FIG. 1) into an aperture 30 (FIG. 2) in the right side of the spiral binder 10. The spiral binder 10 may be operated either in an automatic mode or in a manual mode. In the manual mode, after inserting the spiral coil 28, the operator depresses the advance button 34. This causes the coil feeder 32 (FIG. 5) to spiral the spiral coil 28 through the holes 17 in the stack of papers 12 (FIG. 1), thus binding the stack of papers 12 together as a unit. In the automatic mode, the spiral binder 10 automatically spirals the spiral coil 28 into the stack of papers 12 after insertion of the coil into the aperture 30 in the side of the spiral binder. In the preferred embodiment of the invention, the operator may either control the operation of spiral binder 10 by depressing the advance button 34 or by depressing a foot pedal (not shown) hooked to the spiral binder.

Figure 8:
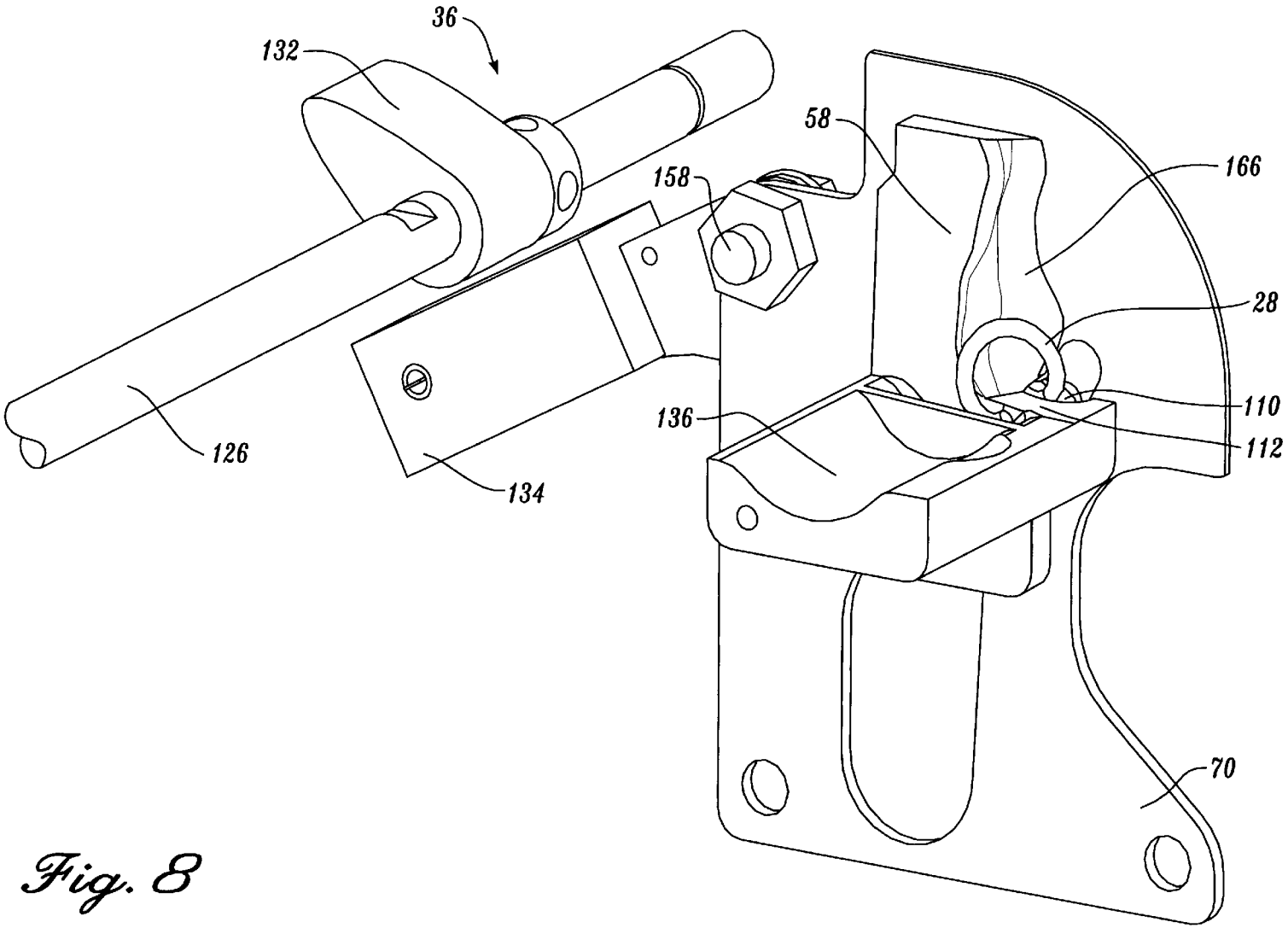
FIG. 8 is a perspective view of the coil cutter block, cutter blade, and stretch wedge.

Once the spiral coil 28 is fed through the holes 17 in the stack of papers 12, the left end of the coil as shown in FIG. I contacts the paper sizing slide 27 as described below. This triggers a lever 180 and, in turn, actuates an on/off switch 214 (FIG. 14) causing the spiral binder 10 to stop feeding the spiral coil 28 into the stack of papers 12. The on/off switch 214 also triggers a coil cutter mechanism 36 (FIG. 8). The coil cutter mechanism 36 cuts the spiral coil 28 to size by cutting off the spiral coil 28 adjacent to the right edge of the stack of papers 12. After the spiral coil 28 is cut to size, the paper hold down bar 20 raises automatically. The bound stack of papers 12 can then be removed from the spiral binder 10 by the operator. The machine is then ready to bind the next book.

In addition to the features identified above, the spiral binder 10 includes a plurality of status indicator lights 40 (FIG. 1) that indicate when the binder is ready to receive the stack of papers 12, when the stack of papers is sized, when the spiral binder is ready to receive a spiral coil 28, when the binder is ready to insert the coil into the stack of papers, when the spiral binder is ready to cut the coil, and when the binding operation is complete. The spiral binder 10 also includes a cancel button 35 that stops the operation of the spiral binder 10 and returns it to a home position as described below. In the home position, the spiral coil 28 is retracted, the paper hold down bar 20 is raised and the locator pins 18 are extended. The spiral binder 10 also includes a coil insertion forward and reverse switch 42 that is used to set the spiral binder to spiral the spiral coil 28 into or out of the sack of papers 12, depending on the setting of the switch.

Figure 12:
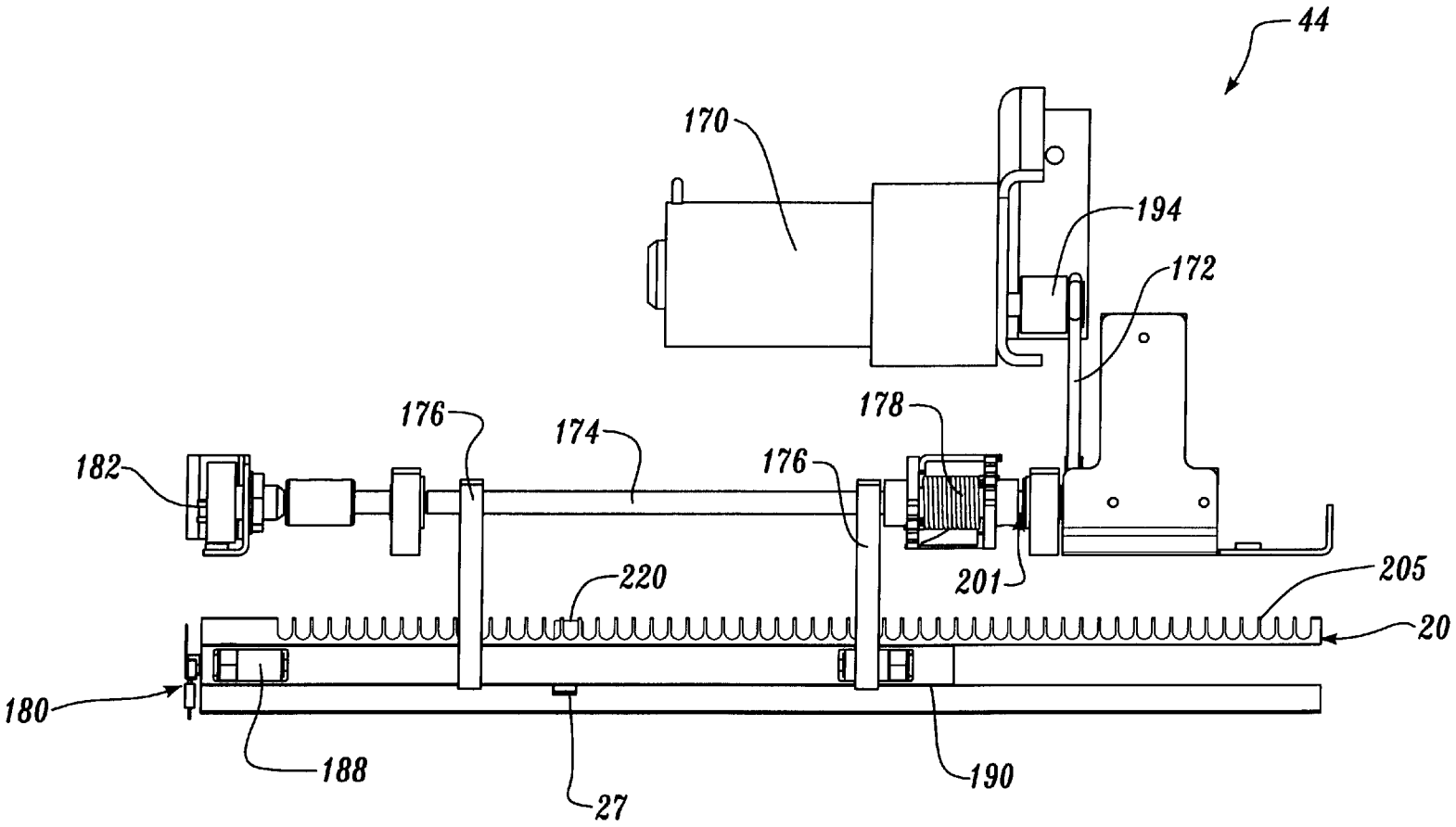
FIG. 12 is a top view of the paper hold down and sizing mechanism.
Figure 13:
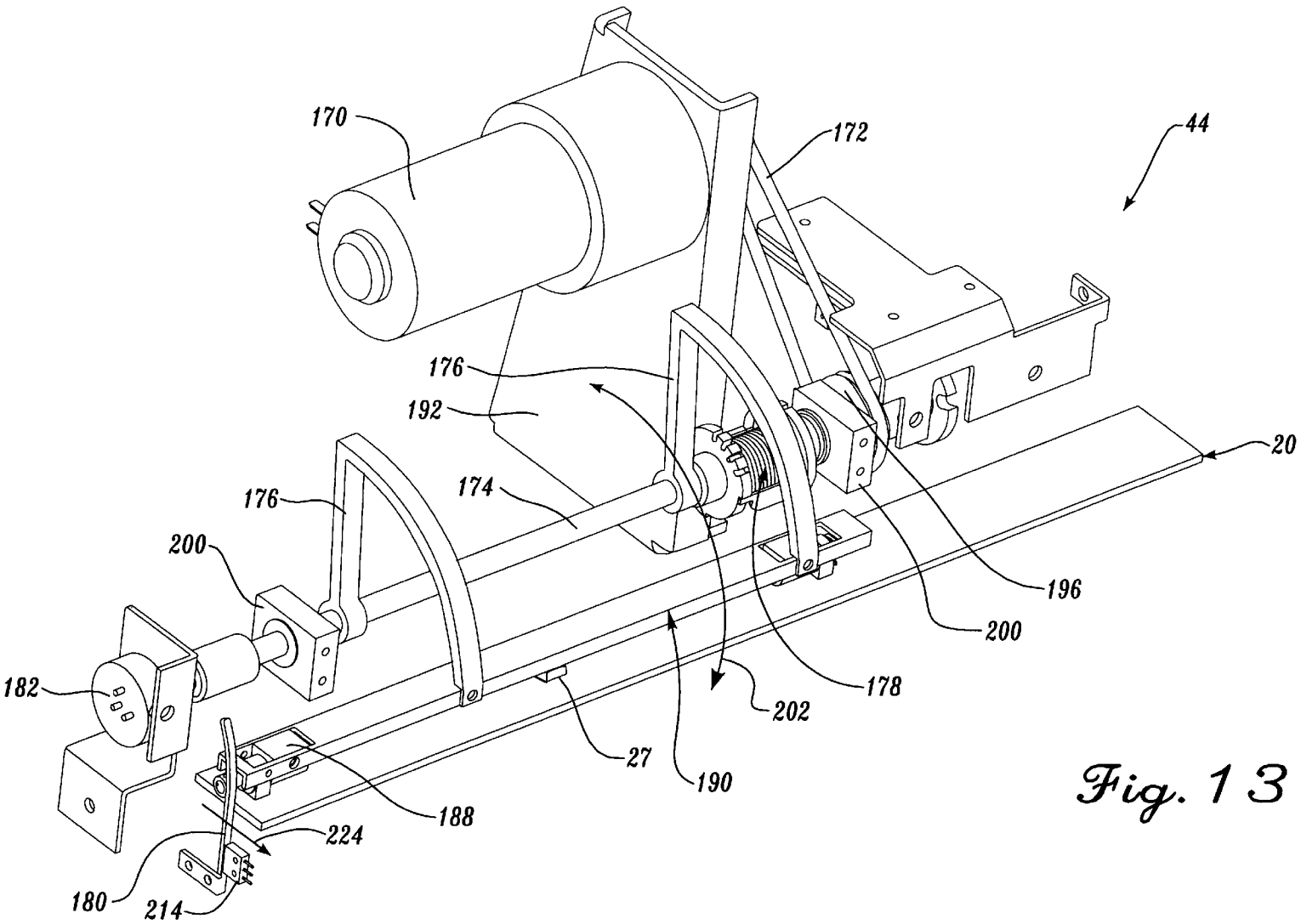
FIG. 13 is a perspective view of the paper hold down and sizing mechanism.
Figure 14:
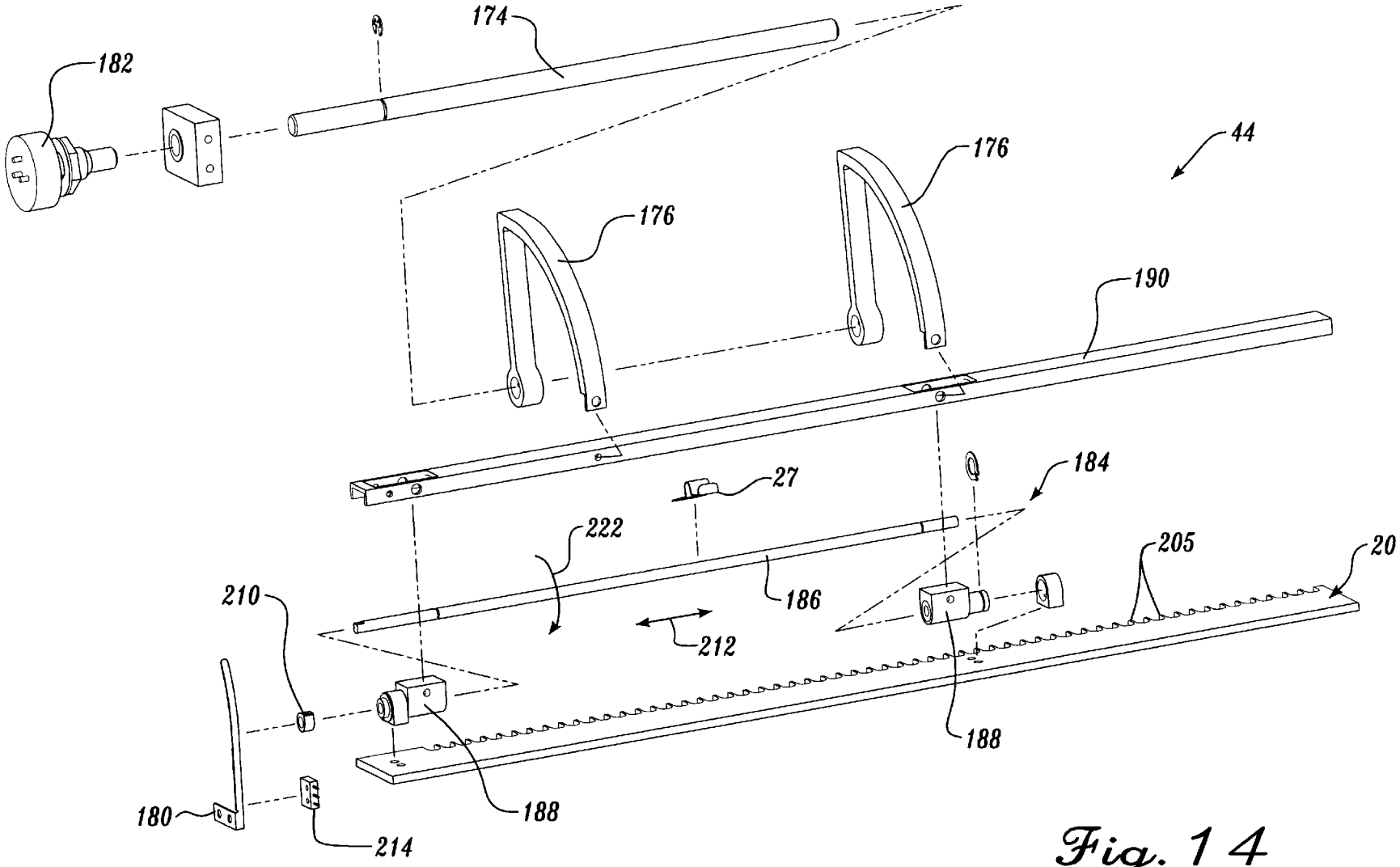
FIG. 14 is an exploded view of part of the paper hold down and sizing mechanism.

The individual parts and operation of the spiral binder 10 will now be described in more detail. The spiral binder 10 consists of a number of different operational mechanisms including a coil feeder 32 (FIGS. 4 and 5), a coil guide assembly 48 (FIGS. 6 and 7), a coil shearing mechanism 36 (FIGS. 8 and 9), a pin extension/retraction mechanism 46 (FIG. 10), and a paper hold down and sizing mechanism 44 (FIGS. 12–14).

Figure 3:
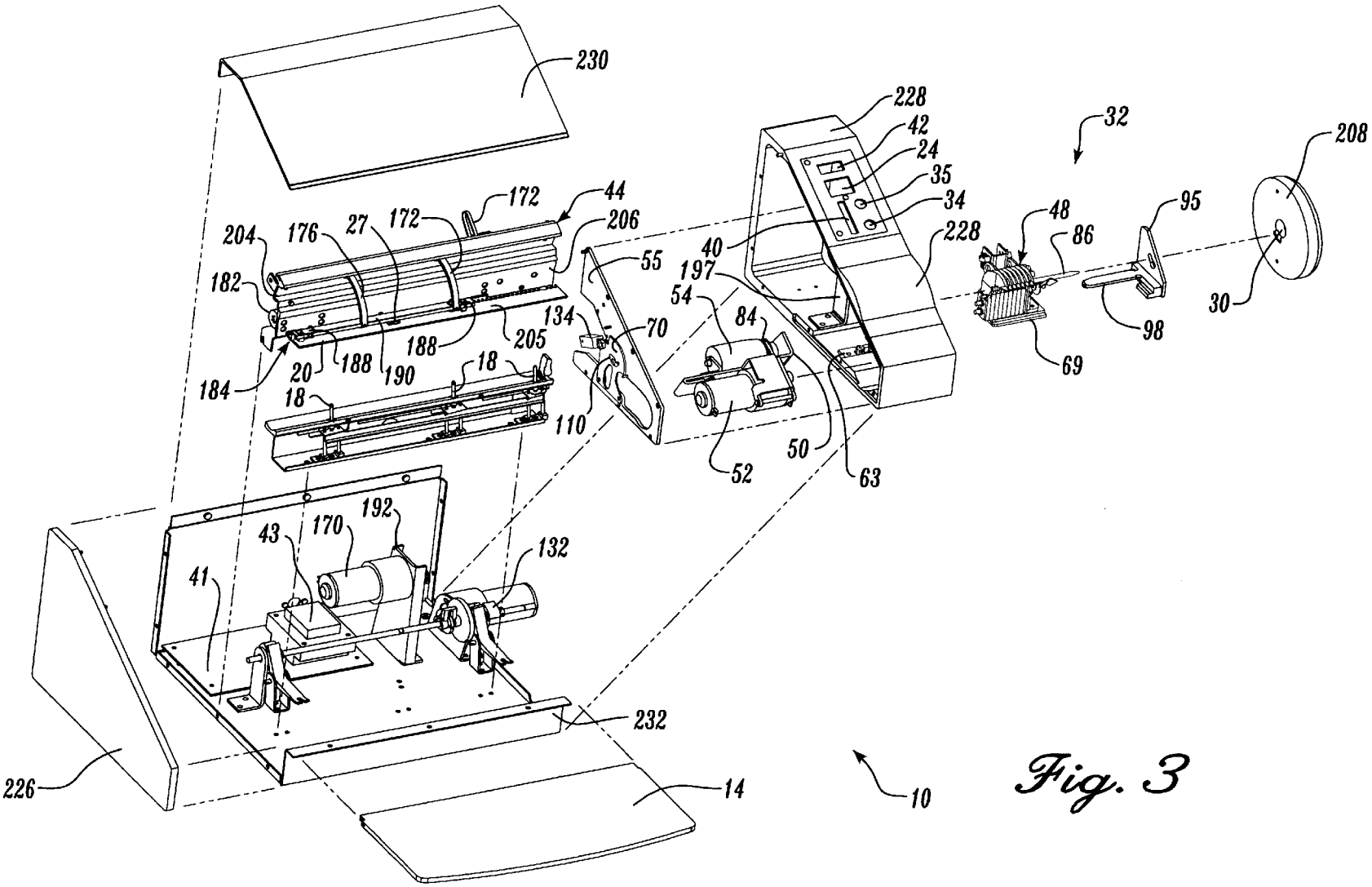
FIG. 3 is an exploded view of the spiral binding apparatus of FIG. 1.

The housing 26 (FIG. 1) of the spiral binder 10 is formed of sheet metal, machined aluminum, cast aluminum, injection molded plastic, or other appropriate materials. The housing 26 is sized to contain and support the internal mechanical parts of the spiral binder 10 and to provide a functional and pleasing exterior appearance. As shown in FIG. 3, the housing 26 includes an access door 228, a circular cover 208, a mounting tray 232, a top cover 230, and a side cover 226. The housing 26 may be disassembled so as to provide access to the internal parts of the spiral binder 10. As will be described in more detail below, some of the internal parts of the spiral binder 10 are specially designed to be modular, so that they can easily be removed and inserted for maintenance and other functions.

The coil feeder 32 (FIGS. 4 and 5) is positioned within the access door 228 adjacent to the right end of the housing 26 as illustrated in FIG. 3. The coil feeder 32 includes a mounting bracket 50, a coil drive motor 52, a drive roller 54, the coil guide assembly 48, a binding adjustment screw 60, a biasing means 62, a drive pulley 64 (FIG. 5) and a drive belt 66 (FIG. 5).

Figure 4:
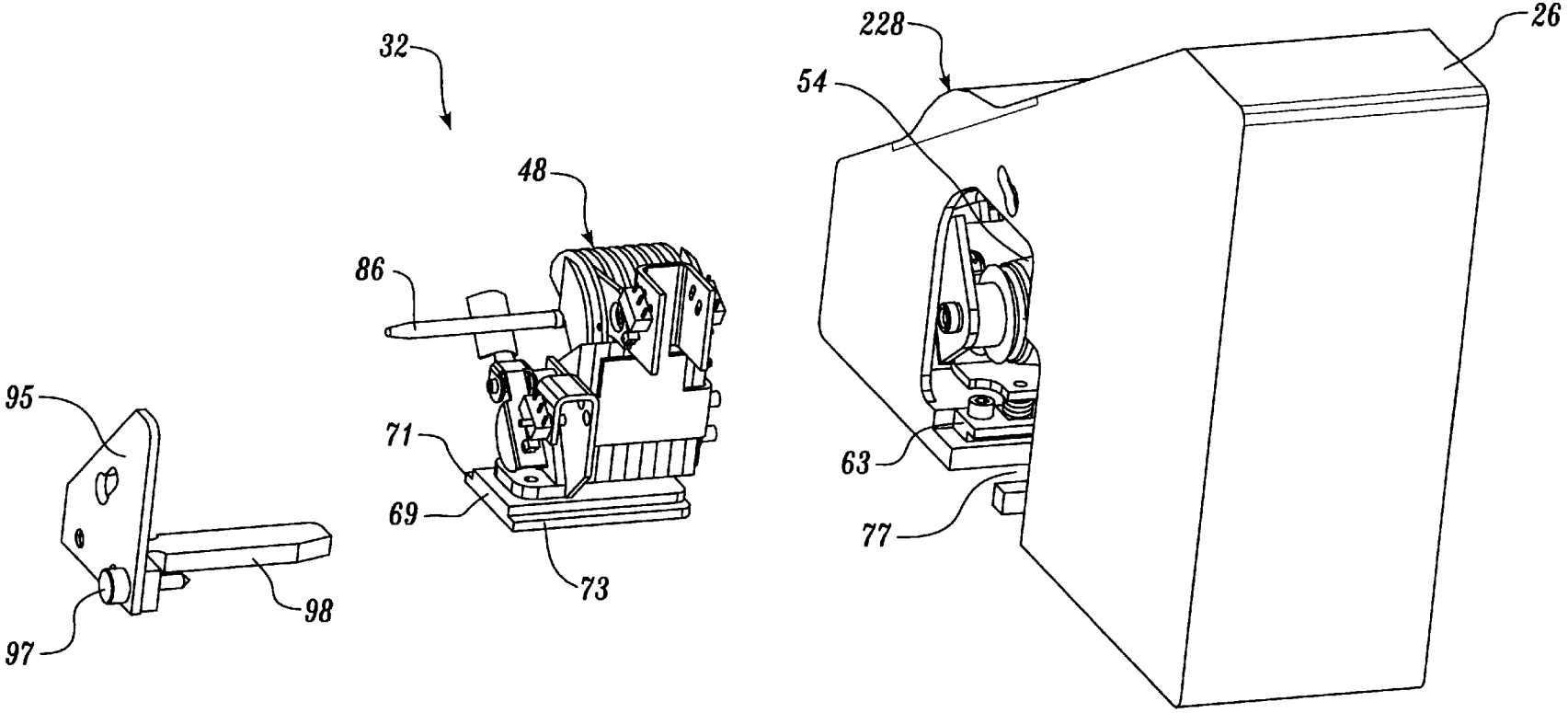
FIG. 4 is an exploded view of the control panel housing and coil feeder of the spiral binding apparatus of FIG. 1.

The front of the mounting bracket 50 (FIG. 5) is pivotally mounted to the interior of the front of the housing 26 through the use of a pivot pin 72. The pivot pin 72 passes through two corners 76 of the mounting bracket 50 and also through a flange (not shown) on the interior of the housing 26. This configuration allows the mounting bracket 50 to pivot around the pivot pin 72 as shown by arrow 113. The end 74 of the mounting bracket 50 is movably mounted to the housing 26 through the use of the binding adjustment screw 60. The end of binding adjustment screw 60 is threaded and screws into a corresponding sized threaded hole in the end 74 of the bracket 50 (FIG. 5). The shaft of the binding adjustment screw 60 is slidable up and down through a hole (not shown) in the bottom of the housing 26 with the head of the binding adjustment screw 60 being larger than the diameter of the hole in the housing so that the head of the screw limits the upward movement of the screw and thus mounting bracket 50. The head of the binding adjustment screw 60 moves up and down as the end 74 of the mounting bracket 50 moves up and down. The end 74 of the mounting bracket 50 is attached by the biasing means 62 (FIG. 5) to the bottom of housing 26 so that the end 74 is spring loaded up and away from the bottom of the housing 228. In the preferred embodiment, the biasing means 62 is a set of compression springs that is attached to the end 74 of the mounting bracket 50 at one end (FIG. 5) and the housing 26 at the other end (FIGS. 3 and 4). As the binding adjustment screw 60 is threaded into or out of the end 74 of the mounting bracket 50, the bracket 50 is moved up or down.

The combination of the pivot pin 72 and binding adjustment screw 60 allow the mounting bracket 50 to rotate around pivot pin 72 to the extent allowed by the binding adjustment screw 60. As described in detail below, this movement allows the coil feeder 32 to account for differing spiral coil diameters and coil filament diameters. The biasing means 62 biases the end 74 of the mounting bracket 50 upward. This biasing action maintains the drive roller 54 in contact with the spiral coil 28 as it is inserted into the coil feeder 32 as described in more detail below.

Figure 5:
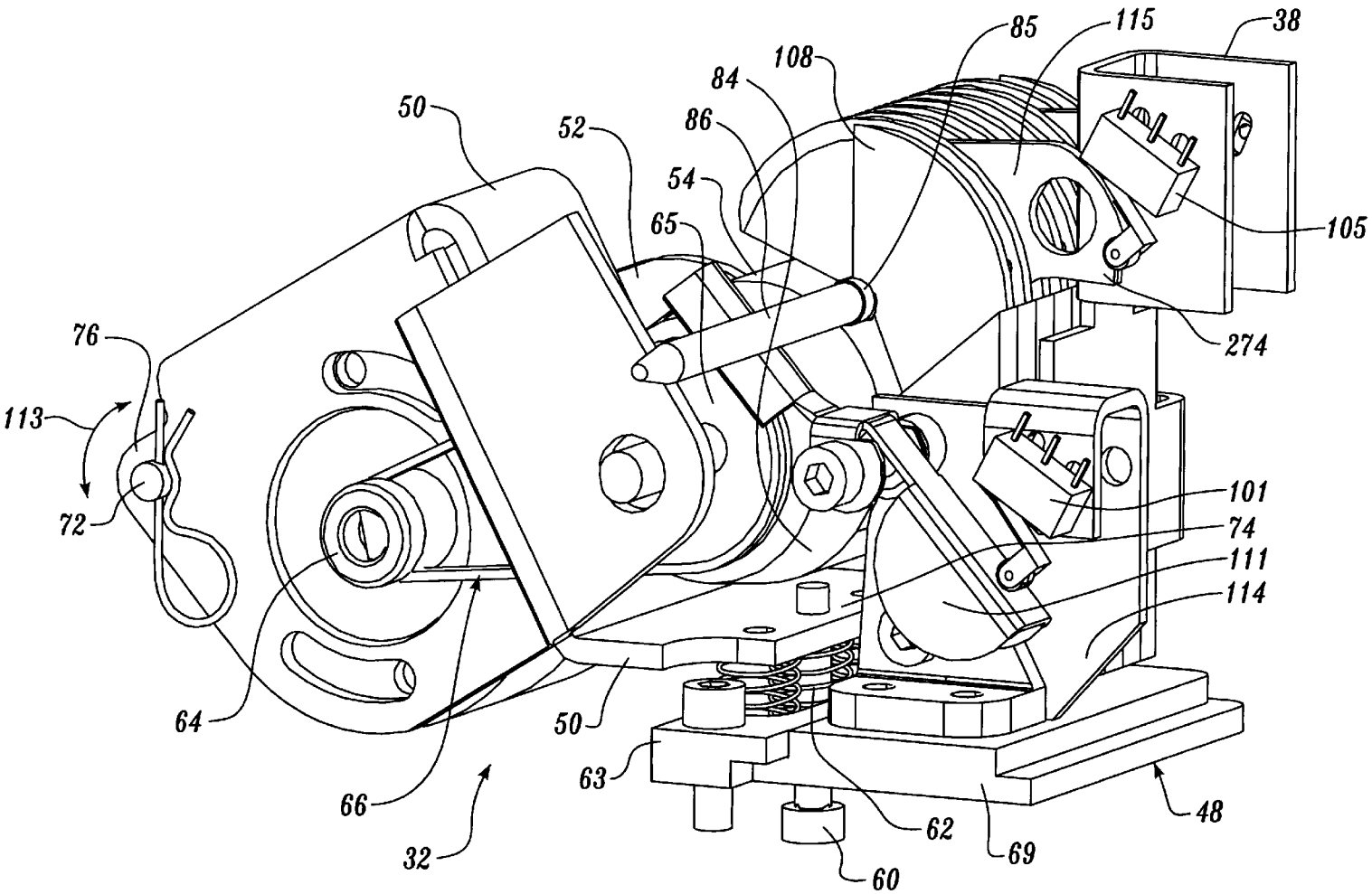
FIG. 5 is a perspective view of the coil feeder of the apparatus of FIG. 1.

A drive pulley 64 is attached to the shaft of the coil drive motor 52 (FIG. 5). The drive belt 66 extends around the drive pulley 64 and around a pulley 65 on the shaft running through the center of the drive roller 54. Rotation of the coil drive motor 52 causes a corresponding rotation of the drive roller 54. As illustrated in FIG. 5, the tapered end 84 of the drive roller 54 slopes inward so that the drive roller 54 has a smaller diameter at the end than in the center or opposite end. The tapered end 84 of the drive roller 54 allows the coil feeder 32 to automatically grasp and begin feeding the spiral coil 28 through the coil feeder as described in more detail below.

In the preferred embodiment, it was found to be advantageous that the taper on the roller be approximately eight and a half degrees plus or minus five degrees. It was also found advantageous to locate the knee that exists between the tapered end 84 of the drive roller 54 and the rest of the drive roller 54 approximately in line with the first guide 108 of the coil guide assembly 48 (FIG. 5).

Figure 6:
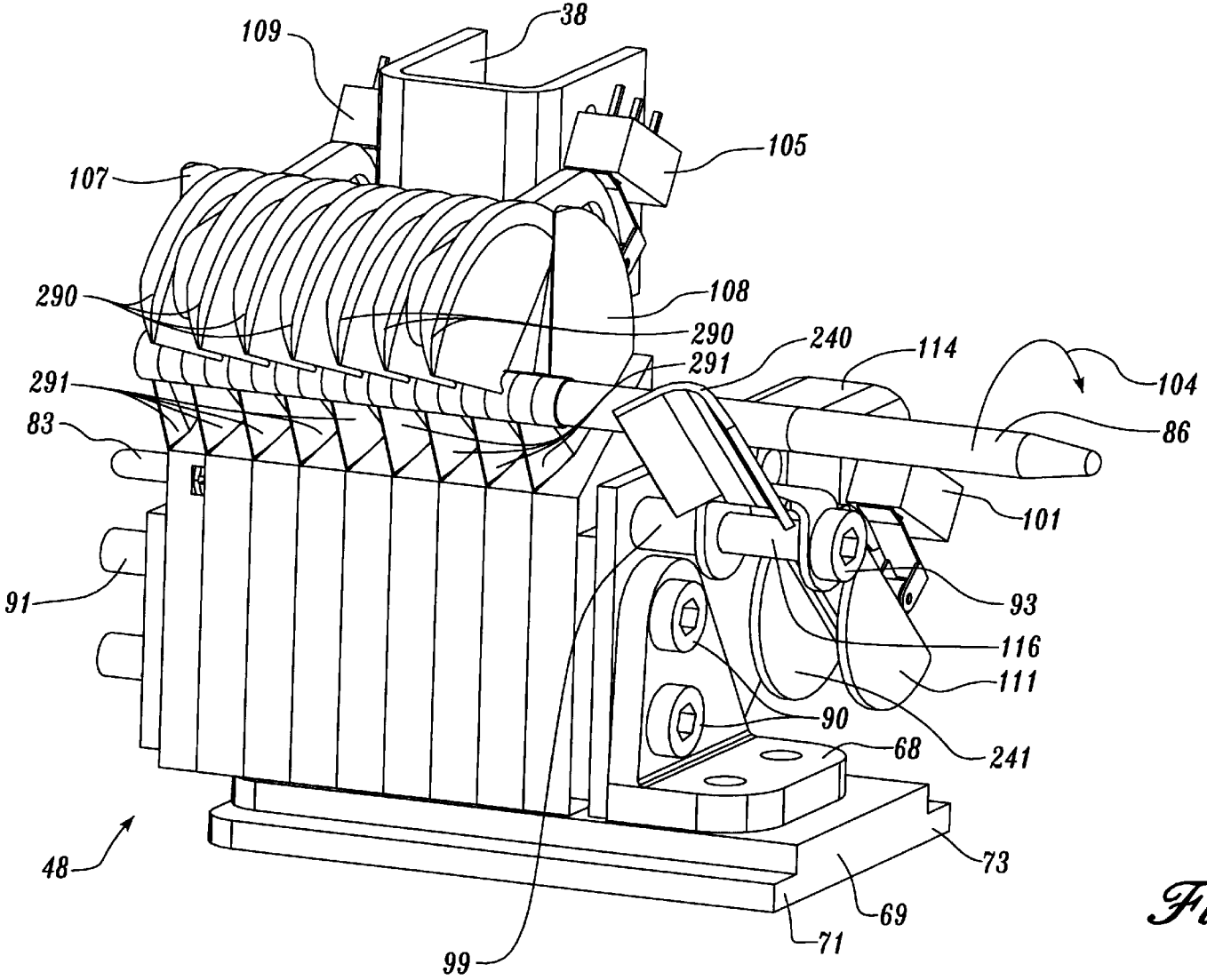
FIG. 6 is a perspective view of the coil guide assembly of the apparatus of FIG. 1.
Figure 7:
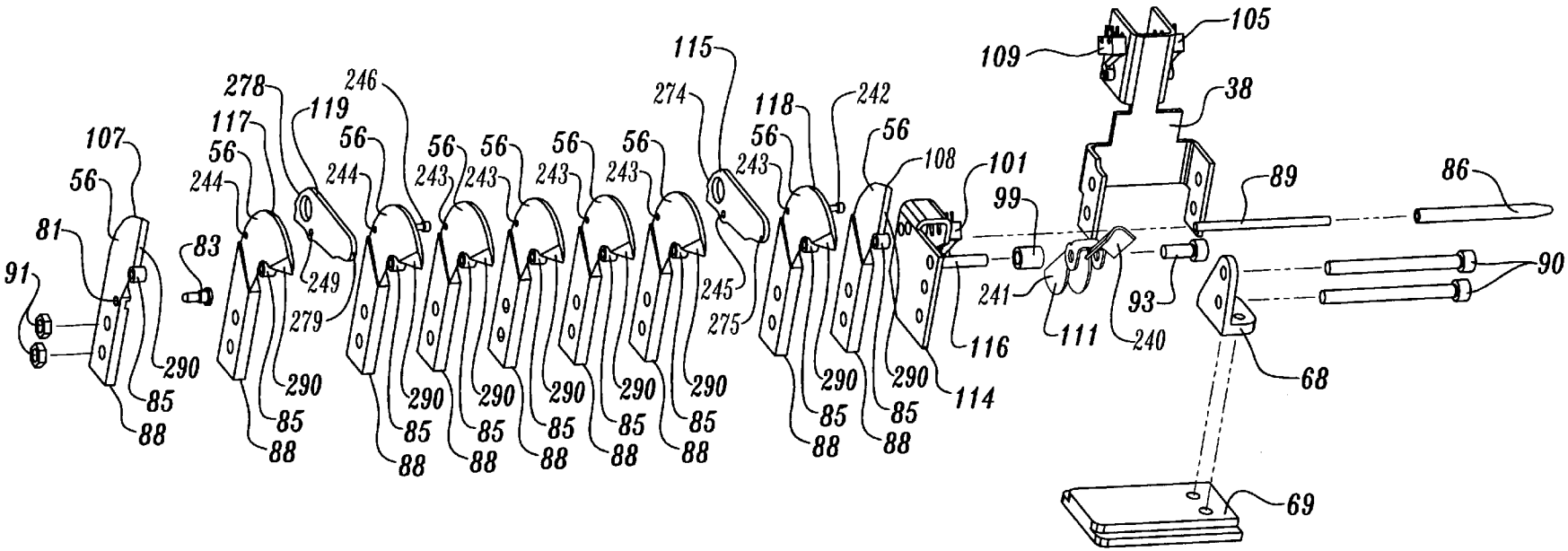
FIG. 7 is an exploded view of the coil guide assembly of FIG. 6.

The coil guide assembly 48 is best illustrated in FIGS. 6 and 7. The coil guide assembly 48 includes a plurality of guides 56, a right mounting bracket 68, a microswitch mounting bracket 38, a side mounting bracket 114, a protrusion pin 83, first, second and third sensors 101, 105 and 109, a mechanical switch 111, a feed shaft 86, a bottom bracket 69, and two mechanical switches 115, 119.

Each guide 56 is generally planar and spirals at least partially around a centrally located shaft section 85. Shaft sections 85 are approximately the same diameter as feed shaft 86, which they line up with when fully assembled to form an extension of the feed shaft. A central shaft 89 extends partially inside feed shaft 86 and the shaft sections 85 in order to attach the feed shafts and shaft sections together. Each guide 56 spirals around the respective shaft section 85 and extends radially outward from the circumference of the shaft section 85 such that the guides are advantageously sloped at an angle of approximately the same pitch as the spiral coil 28 used in the spiral binder 10. However, other pitch coils may still be effectively rotated by the coil guide assembly 48. In addition, the upper leading edge 290 of each guide 56 is chamfered to further help guide the end of the spiral coil 28 as it spirals around each leading edge. The chamfered edges of each guide 56 are important to facilitate the spiraling of coils of varying sizes through the coil guide assembly 48. The chamgered edges also minimize coil binding between the guide assembly 48 and roller 84.

As illustrated in FIG. 6, the upper leading edges 290 of the guides 56 are chamfered from left to right and the lower edges 291 of the guides are chamfered from right to left. The chamfered edges of the guide 56 help to ensure that the end of the spiral coil 28 spirals to either the left or the right of each guide 56 and does not bind on the ends of the guides during operation of the coil guide assembly 48.

As shown in FIG. 7, the guides 56 are formed as separate pieces and are attached together at their lower ends 88 by two fasteners such as bolts 90. The bolts 90 extend through the right mounting bracket 68, the side mounting bracket 114, one side of microswitch mounting bracket 38, the lower ends 88 of the guides 56, and back out through the other side of microswitch mounting bracket 38. The opposite ends of the bolts 90 are secured by nuts 91. The microswitch mounting bracket 38 partially encloses the lower ends 88 and helps hold the guides 56 together. In addition, the mounting bracket 38 is used to support the second and third sensors 105 and 109 as described in more detail below.

As a unit, the coil guide assembly 48 is modular in that it can be slid in and out of the side of control panel housing 228 to assist in maintenance, removing the coil jams, etc. The modularity of the coil guide assembly 48 is partially achieved through use of the protrusion pin 83 and the mounting bracket 69 (FIG. 6). The bracket 69 is attached to the bracket 68 (FIG. 6) by bolts or other suitable fasteners (not shown). The bracket 69 includes a left shoulder 71 (FIG. 6) and a right shoulder 73 (FIG. 6). When inserted into the side of control panel housing 228, the left shoulder 71 is slidably mounted under the edge of a mounting bracket 63 (FIGS. 4 and 5) that is bolted or otherwise attached to the bottom of the housing 26. The right shoulder 73 is slidably mounted under a retaining pin 98 that extends inward from side bracket 95 (FIGS. 3 and 4).

The side bracket 95 is mounted to the side of housing 26 so that the bottom of the retaining pin 98 slides on top of and engages the right shoulder 73 and thereby fixes the right shoulder 73 to the bottom of the housing 26. Side bracket 95 is fixed to the side of housing 26 by a removable fastener 97 (FIG. 4) that engages the housing 26. Once the side bracket 95 is removed, the modular coil guide assembly 48 can be slid in and out of the side of housing 26, thus facilitating maintenance of the guide assembly. The ability to easily slide the modular coil guide assembly 48 out of the housing 26 also allows the easy removal of any coil portions that may become jammed within the coil guide assembly during or after operation of the unit. The biasing means 62, described earlier, is positioned so as to not interfere with the in and out sliding of the coil guide assembly 48.

As the coil guide assembly 48 is slid into the side of housing 26, the end of the protrusion pin 83 fits into a cavity (not shown) which is positioned in the side of a stretch wedge 136 (FIGS. 8 and 9) so as to ensure the proper alignment of the coil guide assembly 48. The head of protrusion pin 83 is mounted in a recess around a hole 81 in the side of the last guide 107 (FIG. 7), while the body of the pin 83 extends through the hole 81 approximately normal to the plane of the guide.

In the preferred embodiment, as illustrated in FIG. 7, all of the guides 56 except for the first and last ones extend approximately two-thirds of the way around the circumference of the shaft sections 85. The first and last guides 108 and 107, extend approximately one-third of the way around the circumference of the shaft sections 85. This allows the drive roller 54 to be placed in proximity with the feed shaft 86, as best illustrated in FIG. 5. The drive roller 54 is located just below the free end of the guides 56 in close proximity with or touching feed shaft 86 and shaft sections 85. When mounted in the housing 26, the right end of the feed shaft 86 extends a distance to the right of the first guide 108. The feed shaft 86 is positioned so that it is aligned with aperture 30 in the housing circular cover 208 on the right side of the housing 26.

During operation of the spiral binder 10, a spiral coil 28 is placed within the aperture 30 such that the left end of the coil is placed around the right end of the feed shaft 86 as seen from the front of the spiral binder. In order to assist an operator in properly positioning the spiral coil 28, a coil rest 100 (FIG. 2) can be utilized. The coil rest 100 is placed adjacent the right side of the housing 26 in line with the aperture 30. The top of the coil rest includes a trough 102 that is sized and aligned with the aperture 30 and feed shaft 86. The trough 102 positions the spiral coil 28 at the right height and lateral position to allow the coil to be inserted into the aperture 30 over the feed shaft 86.

As the spiral coil 28 is placed over the feed shaft 86 and pushed inward, it triggers the first sensor 101 that is mounted on the rear corner of the right side of side mounting bracket 114 (FIG. 6). The first sensor 101 is triggered by a mechanical switch 111 which is rotatably mounted on a cylindrical protrusion 116 that extends outward from the right side of the side mounting bracket 114 approximately normal to the surface of the bracket. The mechanical switch 111 is spaced away from the wall of the side mounting bracket 114 by a cylindrical collar 99 that slides over the cylindrical protrusion 116 prior to sliding the mechanical switch over the protrusion. The mechanical switch 111 is maintained in place on the cylindrical protrusion 116 by a retaining pin 93 that is threaded into the right end of the cylindrical protrusion. The mechanical switch 111 is mounted directly underneath the feed shaft 86.

The mechanical switch 111 is elongate having an upper section 240 that extends upward from the cylindrical protrusion 116 to one side of the feed shaft 86 and a lower section 241 that extends downward from the cylindrical protrusion 116 under the first sensor 101. The mechanical switch 111 pivots about the cylindrical protrusion 116 and is biased clockwise by a spring loaded arm on the first sensor 101 so that the upper portion 240 is biased into contact with the side of the feed shaft 86. As a spiral coil 28 is placed over the feed shaft 86 and pushed inwards, it contacts and pushes the upper portion 240 of the mechanical switch 111 away from the feed shaft 86. As the upper portion 240 is pushed away from the feed shaft 86, the switch pivots counter-clockwise about the cylindrical protrusion 116 causing the lower portion 241 to move upward and trigger the first sensor 101. When the first sensor 101 is triggered, it provides an indication of the coil's presence to the controller or microprocessor (not shown). When a coil's presence is detected by the first sensor 101, the microprocessor causes the coil drive motor 52 to rotate the drive roller 54 counter-clockwise (FIG. 5).

As the spiral coil 28 is pushed further inward, it contacts the tapered end 84 of the drive roller 54. The rotation of the drive roller 54 causes the spiral coil 28 to rotate clockwise around the feed shaft 86 as shown by arrow 104 (FIG. 6). This rotational movement causes the free end of the spiral coil 28 to spiral around the first guide 108. The pitch of the first guide 108 in turn causes the spiral coil 28 to spiral inward around the successive guides 56.

As the free end of the spiral coil 28 passes the second guide 118 of the guides 56, it triggers a second sensor 105 which is mounted on the right side of the microswitching mounting bracket 38 (FIG. 7). The second sensor 105 has a mechanical trigger 115 which is rotatably mounted on a pin 242 which passes through a hole 245 near the bottom of trigger 115. The pin 242 is also threaded through holes 243 in the backs of the right-most guides 56 (FIG. 7), thus maintaining the position of the pin 242. The mechanical trigger 115 is mounted directly over the feed shaft 86. The mechanical trigger 115 is elongate having a front section 275 with extends forward from the hole 245 above the feed shaft 86 and a back section 274 which extends backward from the hole 245 under the second sensor 105 (FIG. 5). The mechanical trigger 115 pivots about pin 242 and is biased counter-clockwise by a spring loaded arm on the second sensor 105 and gravity so that the front section 275 is biased into contact with the upper surface of the feed shaft 86. As a spiral coil 28 is placed over the feed shaft 86 and pushed inwards, it contacts and pushes the front portion 275 of the trigger 115 away from the feed shaft 86. As the front portion 275 is pushed away from the feed shaft 86, the trigger pivots counter-clockwise (FIG. 7) about the pin 242 causing the back portion 274 to move downward and trigger the second sensor 105. When the second sensor 105 is triggered, it provides an indication of the coil's presence to the controller or microprocessor (not shown).

As the free end of the spiral coil 28 approaches the second to the last guide 117 of the guides 56, it triggers a third sensor 109 which is mounted on the left side of the side mounting bracket 38 (FIG. 7). The third sensor 109 has a mechanical trigger 119 which is rotatably mounted on a pin 246 which passes through a hole 249 near the bottom of mechanical trigger 119. The pin 246 is threaded through holes 244 in the backs of the guides 56 (FIG. 7), thus maintaining the position of the pin 246. The mechanical trigger 119 is mounted directly over the feed shaft 86. The mechanical trigger 119 is elongate having a front section 279 which extends forward from the hole 249 above the feed shaft 86 and a back section 278 which extends backward from the hole 249 under the third sensor 109 (FIG. 7). The mechanical trigger 119 pivots about pin 246 and is biased counter-clockwise by a spring loaded arm on the third sensor 109 and gravity so that the front section 279 is biased into contact with the upper surface of the feed shaft 86. As a spiral coil 28 passes over the feed shaft 86, it contacts and pushes the front section 279 of the trigger 119 away from the feed shaft 86. As the front section 279 is pushed away from the feed shaft 86, the trigger 119 pivots counter-clockwise (FIG. 7) about the pin 246 causing the back section 278 to move downward and trigger the third sensor 109. When the third sensor 109 is triggered, it provides an indication of the coil's presence to the controller or microprocessor (not shown).

As the free end of the spiral coil 28 nears the far side of the coil guide assembly 48, it triggers a third sensor 109 mounted on the left side of the microswitch mounting bracket 38 (FIG. 7). The third sensor 109 has a mechanical trigger 119 which is rotatably mounted to the back of the guides 56 to the right of the second-to-the-last guide 117, so that when the spiral coil 28 passes through, it contacts the mechanical trigger 119, causing it to rotate and trigger third sensor 109. The third sensor 109 detects the presence of the end of the spiral coil 28 and passes an indication of the coil's presence to the microprocessor.

Once the end of the spiral coil 28 is detected by the third sensor 109, if the spiral binder 10 is operating in a manual mode, the microprocessor stops rotation of the coil drive motor 52 and waits for the operator to depress the advance button 34 prior to spiraling the spiral coil into the stack of papers 12. If the spiral binder 10 is operating in an automatic mode, the movement of the coil drive motor 52 and thus drive roller 54 continues until the spiral coil 28 is spiraled through the holes in the stack of papers 12 as described below.

The sensors 105 and 109, along with the end-of-coil sensor discussed later, help the microprocessor determine if a length of coil that is too short has been inserted in the coil guide assembly 48. A length of coil that is too short is undesirable because it will be too short to bind the full edge of the stack of papers. As the coil feeder 32 is rolling the spiral coil 28 forward, if the third sensor 109 is detecting a section of coil, the second sensor 105 is also checked to determine if it is also detecting a section of coil. If the second sensor 105 does not detect a section of the coil, then the microprocessor knows that a spiral coil 28 has been inserted which is too short to be triggering both third sensor 109 and second sensor 105. The microprocessor may then either provide a warning signal to the operator, or may automatically operate the coil drive motor 52 in reverse so as to wind the coil 28 back out of the stack of papers 12 and the coil feeder 32, depending on the application. The sensor 109 also controls the spiraling of the coil to prevent the coil from running into the locator pins 18. If the sensor 109 detects the presence of the coil while the locator pins are extended, it instructs the controller (not shown) to stop the motion of the coil until the locator pins are retracted.

As discussed in more detail below, if the sensor 105 does not detect the presence of the coil 128 before the end of the coil sensor is triggered it instructs the controller that the coil being use is too short to bind the stack of papers. The controller then operates the coil drive motor 52 in reverse to wind the coil 28 back out of the stack of papers.

Figure 9:
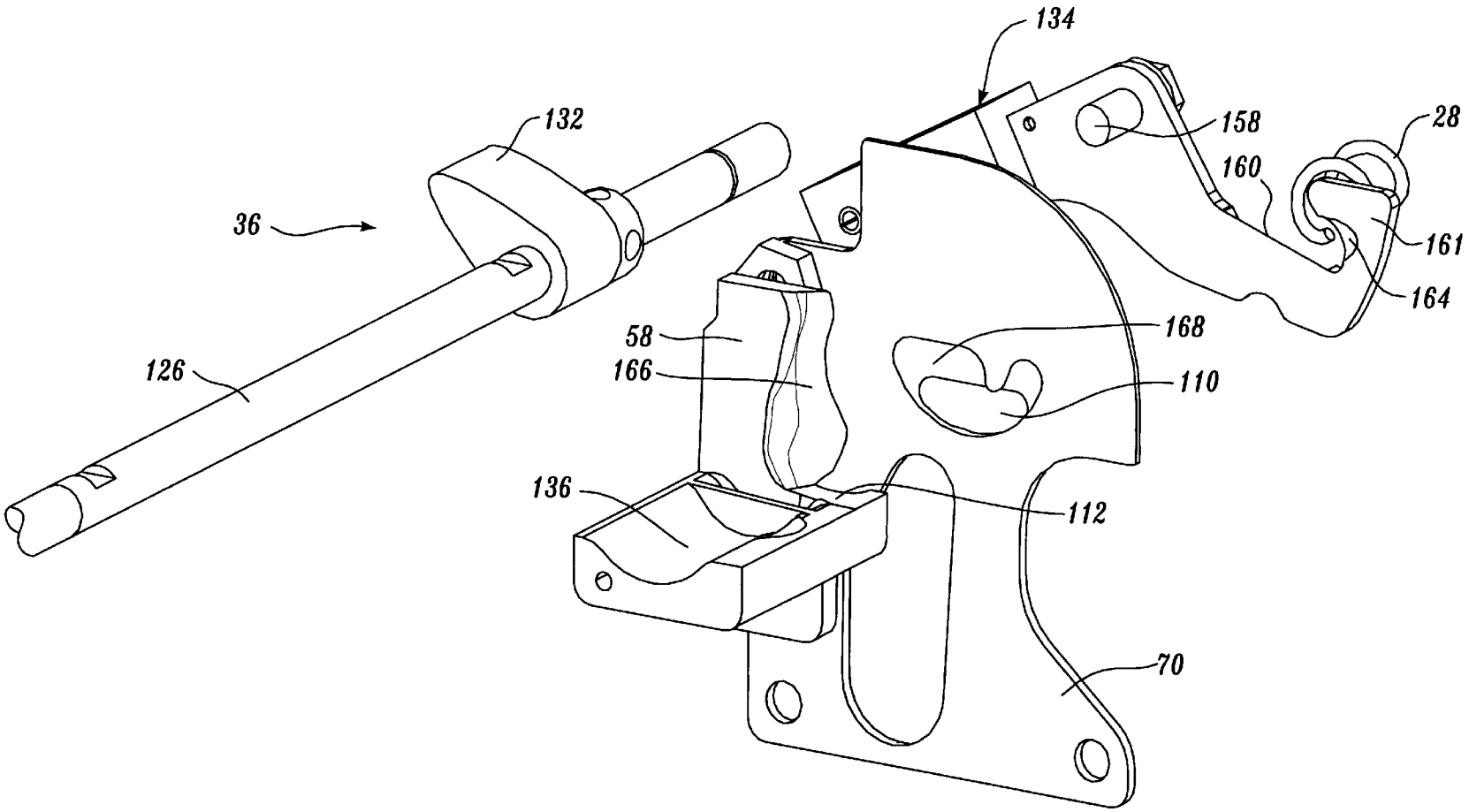
FIG. 9 is an exploded view of the coil cutter block, cutter blade, and stretch wedge of FIG. 8.

Once the spiral coil 28 spirals through all of the guides 56, the free end spirals through a horizontal slot 110 in a left mounting bracket 70 (FIG. 9). Mounting bracket 70 is fixed to bracket 55 (FIG. 3) which is fixed to the housing 26. The slot 110 is chamfered on its edges 168 to help guide the end of the coil as it is spiraled forward. As best illustrated in FIG. 8, as the free end of the coil spirals through the slot 110, it spirals around a coil spreading bracket 58. The coil spreading bracket 58 includes a spreading wedge 112 that spreads the first coil of the spiral coil slightly so that the free end is directed into the first hole at the right side of the stack of papers 12. The coil spreading bracket 58 has specially chamfered edges 166 to help guide the end of the coil as it is spiraled forward. The chamfered edges 168 of the slot 110 of the coil spreading bracket 58 are important to facilitate the rolling of coils of various sizes which may be fed through the machine to help prevent the end of the coil from becoming caught on the edges of the slot 110 or stack of papers 12.

The spiral binder 10 continues to spiral the spiral coil 28 through the holes 17 and stack of papers 12 until the coil reaches the left edge of the stack of papers as described below. The spiral coil 28 is then cut off at the slot 110 by the coil shearing mechanism 36 as described below. The tapered end 84 of the drive roller 54 allows the drive roller to engage and start to spiral the spiral coil 28 through the guides 56 regardless of the coil diameter or filament size used. In addition, the pivotal mounting of the mounting bracket 50 and drive roller 54 also allows the coil feeder 32 to account for spiral coils 28 of different diameters and filament sizes.

As described above, the surface of the drive roller 54 is positioned adjacent the surface of the feed shaft 86 (FIG. 5). The biasing force of the biasing means 62 biases the drive roller 54 upward such that the surface of the drive roller 54 is biased into the surface of the feed shaft 86. As a spiral coil 28 is fed onto the feed shaft 86, it spirals around the guides 56 in between the surface of the drive roller 54 and the surface of the feed shaft 86. As the spiral coil 28 spirals along the feed shaft 86, the mounting bracket 50 moves downward slightly against the biasing force of the biasing means 62 in order to provide clearance for the spiral coil 28. Thus, the biasing force of the biasing means 62 maintain the surface of the drive roller 54 in contact with the surface of the coil 28. In addition, the biasing means 62 ensures that the spiral coil 28 is firmly pressed upward into the feed shaft 86 by the drive roller 54. Spiral coils 28 having filaments of greater diameters cause the drive roller 54 to be displaced a greater distance downward away from the feed shaft 86, thus allowing the greater filament size coil to move between the drive roller 54 and feed shaft 86. Similarly, when a spiral coil 28 of smaller diameter filament is used, the biasing means 62 press the drive roller 54 upward, thus accounting for the smaller diameter of the coil filament. Therefore, the coil feeder 32 of the present invention automatically accounts for varying filament diameters and roller wear.

The feeding action of the coil feeder 32 is partially dependent on the drive roller 54 pressing the portion of the spiral coil 28 in contact with the drive roller against the feed shaft 86. The feeder action is not dependent upon contact between the spiral coil 28 and feed shaft 86 at other locations, thus, the action of the coil feeder 32 is not dependent upon the use of a coil of a specific diameter.

In the preferred embodiment, the drive roller 54 is formed of a pliable rubber or plastic material that deforms slightly upon contact with the spiral coil 28. The pliable surface of the drive roller 54 allows the roller to obtain a good grip on the spiral coil 28, thus helping to assure that the coil spirals through the guides 56, slot 110, and holes 17 in the stack of papers 12. The minimum clearance between the drive roller 54 and feed shaft 86 is adjusted by adjusting the binding adjustment screw 60, as described above. Adjusting the binding adjustment screw 60 changes the maximum allowed upward movement of the free end 74 of the mounting bracket 50. This allows the operator to fine tune the interaction between the drive roller 54 and spiral coil 28 to insure that the coil spirals through the stack of papers 12.

Each time the spiral coil 28 is rotated in a full revolution, the left end of the coil goes through a complete cycle during which the end enters and leaves a hole 17 in the stack of papers 12. As described below, while spiraling the spiral coil 28 through the holes 17 in the stack of papers 12, it is advantageous to do so in a pulsed manner, rather than continuous spinning of the coil at a constant rate of rotation. In the preferred embodiment, the pulsing is implemented by a controller (not shown) connected to the coil drive motor 52. The controller periodically provides the coil drive motor 52 with an initial inertia and then cuts off power to the motor, the inertia causing the motor 52 to rotate an angular distance. The inertia and angular distance is slowed or halted by at least in part by the resistance of the motor itself, the resistance of the drive roller 54, and/or the resistance of the spiral coil 28 as it is spiraled into the holes 17 in the stack of papers 12. The controller may be a microprocessor which includes a program for operating the drive motor 52 in a pulsed manner. The pulsing motion could also be achieved with a stepping motor, rather than rely on inherent friction to slow the coil spiraling.

Figure 11:
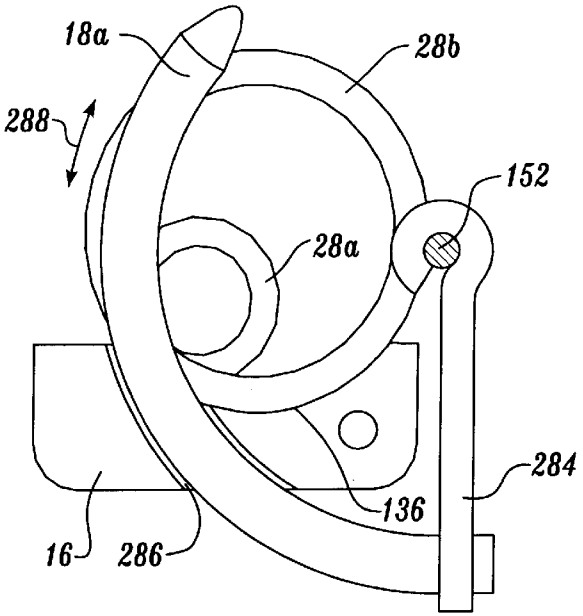
FIG. 11 is an end perspective view of a curved pin shown with two coils of alternate diameters.

Pulsing or periodically changing the rate of rotation of the coil helps the spiral coil 28 pass through the holes 17 in the stack of papers 12 in the following ways. First, as the end portion of the spiral coil 28 is spun through the holes 17, it causes each hole in the stack of papers 12 to become aligned according to the curve of the coil. As can be seen in FIG. 11, coils of different diameters such as coil 28*a* and 28*b*, will cause holes 17 in the stack of papers 12 to take on different curvatures. As the stack of papers redistributes to reform each hole 17 according to curve of the coil, the stack of papers 12 is also lined up according to the curve. As the stack of papers 12 begins to shift to become better aligned with the curve of the coil, the holes 17 further down the edge of the papers also begin to line up according to the curve. Once this begins to happen, when the end portion of the spiral coil 28 passes into a hole 17 which has been properly aligned, then the end portion has less difficulty making its way through the hole.

Also, thicker stacks of paper with larger diameter coils may require more pulsing energy for the stack of papers 12 to shift to align properly. The pulsing method accounts for this by being sensitive to the thickness of the stack of papers 12 in that each time the coil drive motor 52 is given an initial inertia, the spiral coil 28 only travels as far as the momentum takes it against the friction which results. The thicker stacks of paper with greater friction will require more pulses and will thus be provided with more pulsing energy to align the papers. More pulses are given for thicker books, and less for thinner books as controlled by a microprocessor based on the measured thickness of the stack of papers.

Another way in which the pulsing method works is that it allows the end portion of the spiral coil 28 to back off slightly from a position in which it becomes caught on the edge of the hole. For example, if the end portion of the spiral coil 28 does become caught on the edge of a hole 17, the pulsing method allows the spiral coil 28 to stop (and/or possibly rebound slightly in an embodiment where there is no forward force until the next pulse arrives), rather than being driven further into the sticking point. When the next pulse arrives, the end of the spiral coil 28 often travels on a slightly different pathway (due to the shifting of the stack of papers 12 or the slight deforming of the coil itself) by which it often passes by the sticking point.

As the spiral coil 28 spirals through the slot 110 (FIGS. 8 and 9), it enters the coil shearing mechanism 36 and the coil spreading bracket 58. The spiral coil 28 then enters the pin extension/retraction mechanism 46 (FIG. 10). The coil shearing mechanism 36 includes a cutter cam 132 and a coil cutter 134. The pin extension/retraction mechanism 46 includes a drive motor 120, drive gear (not shown), reduction gear 124, cam shaft 126, cam lobes 128, levers 130, guide plate 16, locator pins 18, and guide shafts 146.

The guide plate 16 of the pin extension/retraction mechanism 46 (FIG. 10) is located at the rear of the binding platform 14 (FIG. 1) and extends across the width of the binding platform. The guide plate 16 has a concave upper surface 136. As the spiral coil 28 exits the slot 110 and spirals into the holes 17 in the stack of papers 12, it moves over the width of the guide plate 16 within the concave surface 136. The concave upper surface 136 helps to guide the spiral coil 28 and maintain it in the proper position as it spirals through the holes 17 in the papers 12.

The locator pins 18 are spaced over the length of the guide plate 16 and extend through correspondingly located apertures 138 in the guide plate 16. Prior to beginning binding, the locator pins 18 are extended through the apertures 138 as illustrated in FIG. 10 and as described below. The stack of papers 12 is then placed and located in the proper position on the guide plate 16 and binding platform 14 through the use of the locator pins 18. The stack of papers 12 is placed on the binding platform 14 such that the locator pins 18 pass through the holes 17 in the stack of papers 12. However, if the locator pins 18 remained extending through the holes 17 in the stack of papers 12, they would interfere with the spiral coil 28 passing through the holes 17 in the stack of papers 12. Thus, once the stack of papers 12 are in position, and the paper hold down bar 20 (FIG. 1) is in place (as described below), the locator pins 18 are retracted. When retracted, the top of the locator pins 18 are located below the concave upper surface 136 of the guide plate 16.

In order to properly locate the stack of papers 12 so that the spiral coil 28 may be easily spiraled through the holes 17, the locator pins 18 are mounted at an angle with respect to the surface of the guide plate 16. The locator pins 18 are angled from right to left at approximately the same angle as the loops of the spiral coil 28. In addition, the pins are angled slightly forward in order to assist the curved free end of the spiral coil 28 in passing through the holes 17.

As shown in FIG. 10, each of the locator pins 18 is mounted on a support for frontal connecting plate 145, so that when the two outer locator pins are raised or lowered, the center locator pin is also raised or lowered. The connecting plate 145 is in turn slidably mounted upon six guide shafts 146, two guide shafts located around each locator pin 18.

The lower ends of the guide shafts 146 are mounted to the bottom of housing 228 by floating mounts 143. Floating mounts 143 include a mounting bracket 148 and specially designed shoulder screws 149. Shoulder screws 149 are designed to allow the mounting brackets 148 to shift slightly beneath the heads of the shoulder screws 149. The body of shoulder screws 149 extends through an aperture (not shown) in mounting bracket 148. The aperture is larger in diameter than the body of the shoulder screw 149, but smaller in diameter than the head of shoulder screw 149. Also, the body of shoulder screw 149 (not shown) includes a threaded lower portion which screws into the bottom of housing 228, and an upper portion which is smooth and wider than the lower portion such that it does not screw into the bottom of housing 228. The smooth upper portion is of sufficient length to create a spacing beneath the head of the shoulder screw 149 which prevents the head of the shoulder screw 149 from being tightly fastened onto the upper surface of the mounting bracket 148. Thus, when the mounting bracket 148 is secured by the shoulder screws 149, the mounting bracket 148 is able to shift slightly beneath the heads of shoulder screws 149. Each guide shaft 146 extends upward from a mounting bracket 148 and the upper ends slide into a corresponding cavity (not shown) in the underside of the guide plate 16. The cavity which the end of the guide shaft 146 slides into is slightly larger in diameter than the guide shaft 146 so as to allow the end of the guide shaft 146 to shift slightly within the cavity.

Each guide shaft 146 also extends through a correspondingly sized hole in the horizontal connecting plate 145 to move up and down from the lower surface of the guide plate 16 while supporting the locator pins 18 in the proper position.

The shifting of the guide shafts 146 which is allowed by the floating mounts 143 and cavities in the guide plate 16 is desirable to assist the smooth removal of the locator pins 18 from the stack of papers 12 and to prevent binding of pins in guide plate 16. During the binding process, the stack of papers 12 tends to shift slightly so as to press the sides of the holes 17 in the paper against the locator pins 18 and thus otherwise inhibit the smooth removal of the pins 18 from the holes 17. By allowing the guide shafts 146, and thus the pins 18, to shift slightly, the pins 18 are able to shift with the stack of papers 12 and can continue to be removed smoothly.

The two outer locator pins 18 and horizontal connecting plate 145 interact with one end of two opposing L-shaped levers 130. The fulcrum of each lever 130 is rotatably mounted in between the forks of a U-shaped support bracket 150 by a pivot pin 152. Each support bracket 150 is in turn mounted to the bottom of the housing 228. The opposite end of each lever 130 engages one of the cam lobes 128. Each cam lobe 128 is mounted upon the cam shaft 126 that extends approximately parallel to the guide plate 16. A reduction gear 124 is mounted on the right end of the cam shaft 126 adjacent the mounting bracket 121.

The drive motor 120 is attached to the bottom of the housing 228 by a mounting bracket 121 so that the drive gear (not shown) attached to the shaft of the drive motor is approximately in line with the reduction gear 124. The drive gear engages the reduction gear 124 attached to the cam shaft 126. An optical encoder wheel (not shown) is also mounted on the cam shaft 126. The optical encoder wheel passes through a sensor (not shown) that is connected to the microprocessor that operates the spiral binder.

After the stack of papers 12 is properly positioned on the binding platform 14 as described above, the microprocessor causes the drive motor 120 and thus the drive and reduction gears, optical encoder and cam shaft 126 to rotate. As the cam shaft 126 rotates, the cam lobes 128 also rotate. As the cam lobes 128 rotate, they contact one end of the levers 130 causing them to pivot about pivot pins 152 thus extending or retracting the locator pins 18, including the center pin 18 which has no lever 130 but which is rigidly connected to the outer two pins 18 by connecting plate 145. As the optical encoder rotates, the sensor provides positional information to the microprocessor. This positional information is used by the microprocessor to shut off the drive motor 120 when the locator pins 18 are either fully extended or fully retracted. The optical encoder also provides positional information regarding the position of the coil cutter 134 as described below.

In an alternate embodiment, curved pins 18*a* (FIG. 11) may be used to further facilitate the alignment of the stack of papers 12 for insertion of a spiral coil 28. Like locator pins 18, a plurality of curved locator pins 18*a* are spaced over the length of the guide plate 16 and extend through correspondingly located apertures 286 (FIG. 11) in the guide plate 16. Prior to beginning binding, the locator pins 18*a* are extended through the apertures 286 as illustrated in FIG. 11 and as described below. The stack of papers 12 is then placed and located in the proper position on the guide plate 16 and binding platform 14 through use of the curved locator pins 18*a*. The stack of papers 12 is placed on the binding platform 14 such that the curved locator pins 18*a* pass through the holes 17 in the stack of papers 12. Once the papers 12 are in position, and the paper hold down bar 20 (FIG. 1) is in place (as described below), the curved locator pins 18*a* are retracted. When retracted, the tops of the curved locator pins 18*a* are located below the concave surface 136 of the guide plate 16.

As shown in FIG. 11, each of the curved locator pins 18*a* are mounted on the lower edge of a support base 284. The upper edge of the support base 284 is rotatably mounted in between the forks of the U-shaped support bracket 150 (FIG. 10) by a pivot pin 152 (FIG. 11). Each support bracket 150 is in turn mounted to the bottom of housing 228. The support base 284 engages the cam lobes 128 (FIG. 10) such that when cam lobes 128 rotate, the locator pins 18*a* are extended or retracted. In a manner similar to that described above with respect to the straight locator pins, the drive motor 120, as controlled by the microprocessor (not shown), extends or retracts the curved locator pins 18*a*. As illustrated in FIG. 11, the curved nature of the locator pins 18*a* improve the alignment of the stack of papers 12 for coils of varying diameters, as shown by a smaller coil 28*a* and a larger coil 28*b*. The improved alignment of the holes in the stack of papers helps coils of various sizes to be more easily spiraled into the holes. The improved alignment provided by curved locator pins 18*a* also allows the spiral binder 10 to bind thicker stacks of paper with a given coil size than would otherwise be possible using straight alignment pins.

The fulcrum of the coil cutter 134 (FIG. 8) is pivotally attached to the left mounting bracket 70 by a pivot pin 158. One end of the coil cutter 134 extends forward from the pivot pin 158 and includes a beveled cutting blade 160. Coil cutter 134 is specially shaped at its end with a hooked extension 161 with chamfered edges 164 so as to facilitate the guiding of the end of the spiral coil 28 through the coil cutter 134. Particularly for larger coils, where the angle at which the coil is wound along its axis is smaller, the chamfered edges 164 and hooked extension 161 help guide the end of the coil which might otherwise have difficulty making its way into the slot 110 as the spiral coil 28 is rolled. When in a retracted position, the cutting blade 160 is located directly beneath the slot 110, while the extended, hooked extension 161 is located above the slot 110. The opposite end of the coil cutter 134 extends rearward and engages a cutter lobe 132 which is mounted on the cam shaft 126. When instructed, the drive motor 120 drives the cam shaft 126, thus causing the cutter lobe 132 to engage the rearward end of the coil cutter 134. This causes the coil cutter 134 to pivot around pivot pin 158, moving the cutting blade 160 counterclockwise (FIGS. 8 and 9). The counterclockwise movement of the cutting blade 160 causes it to move upward over the slot 110, thus shearing the spiral coil 28 at the slot 110.

The paper hold down and sizing mechanism 44 will now be described by reference to FIGS. 12–14. The paper hold down and sizing mechanism 44 includes a drive motor 170, shaft 174, two support arms 176, a spring clutch 178, a hold down comb 20, a position sensor 182, and paper sizing mechanism 184 (FIG. 14). The paper sizing mechanism 184 includes a shaft 186, two bearing block assemblies 188, the paper sizing slide 27, an actuator lever 180, an on/off switch 214, and a support channel 190.

The drive motor 170 is attached to a support flange 192 (FIG. 13) that is in turn mounted to the bottom of the mounting tray 232. The drive motor 170 is also connected to a controller printed circuit board assembly (not shown). A drive pulley 194 is mounted on the drive shaft of the motor 170 (FIG. 12). The drive belt 172 extends around the drive pulley 194 and also extends around a pulley 196 (FIG. 13) mounted upon a rotatably mounted shaft 201 (FIG. 12). The left end of the shaft 201 is connected to the right-hand side of the spring clutch mechanism 178 (FIGS. 12 and 13). The opposite end of the spring clutch 178 is connected to the shaft 174. The arms 176 (FIGS. 12 and 13) are attached to the shaft 174 at one end and extend radially outward from the shaft. The arms 176 then arc downward passes through two openings in the comb housing 206 and are connected to a U-shaped support channel 190 by fasteners (not shown) that pass through the arms 176 and support channel 190. The support channel 190 is in turn attached to the bearing blocks 188 by fasteners not shown. The bearing blocks 188 are spaced laterally apart and are attached to the hold down comb 20 using fasteners (not shown).

The shaft 174 is rotatably mounted within laterally spaced bearings 200 (FIG. 13) that are attached to the internal structure of the comb housing 206. Rotation of the drive motor 170 causes the shaft 174 to rotate. This in turn causes the arms 176 and thus hold down comb 20 to arc radially upward or downward as illustrated by arrow 202 (FIG. 13). In its retracted position (not shown) the hold down comb 20 is raised away from the binding platform 14 and retracted within a recess 204 in the comb housing 206 of the spiral binder 10 (FIG. 1). In its lowered position as shown in FIGS. 1 and 13, the hold down comb 20 moves downward toward the binding platform 14 on top of the stack of papers 12. When in its lowered position, the hold down comb 20 exerts a downward directed force approximately normal to the surface of the binding platform 14 on the stack of papers 12. This downward directed force maintains the stack of papers 12 in position during binding. The drive motor 170 is connected to the drive shaft 174 through the spring clutch 178 in order to allow for stacks of paper 12 of varying thickness. The spring clutch 178 allows the shaft 201 to rotate slightly with respect to the shaft 174. Thus, when stacks of paper 12 of greater thicknesses are inserted in the spiral binder 10, the hold down comb 20 is capable of placing a downward directed force (overdrives 200) on the stack of papers without binding the motor 170. The spring clutch allows upward movement of the hold down assembly to prevent injury.

It is important that the portion of the stack of papers 12 surrounding the holes 17 be maintained in position on the binding platform 14 during binding. Therefore, the rear edge of the hold down assembly 44 includes a plurality of comb-like teeth 205 (FIGS. 12 and 14) that extend rearward from the rear edge of the hold down bar 20. Each of the teeth 205 are positioned to extend between the holes 17 in the stack of papers 12. Thus, the teeth 205 provide a downward directed force on the stack of papers 12 while not interfering with the spiraling motion of the spiral coil 28 through the holes 17. Also, the downward force of the hold down comb 20 on the stack of papers 12 is designed to be firm enough to hold the stack of papers 12 in place, but also light enough to allow the papers 12 to shift slightly to allow the holes 17 in the papers to be aligned according to the curve of the coil 28 as the coil is being wound through.

In addition to holding the stack of papers 12 in place during binding, the hold down and sizing mechanism 44 also provides the user an indication of the thickness of the stack of papers being bound. The indication of the thickness of the stack of papers is provided by the position sensor 182 connected to the left end of the shaft 174. As the shaft 174 rotates, it also rotates the position sensor 182. In the preferred embodiment, the position sensor 182 is a variable potentiometer. The position sensor 182 is connected to the controller. As the shaft 174 rotates, it rotates the potentiometer, thus changing the electrical resistance of the potentiometer. The change in resistance of the potentiometer is detected by the controller electronics. This change in resistance is used by the controller to determine the position of the shaft 174 and thus the thickness of the stack of papers 12.

In alternate embodiments of the invention, the sensor 182 could be an encoder wheel or other form of position sensing device.

The elements of the sizing mechanism 184 are also mounted on the hold down comb 20. The sizing mechanism 184 is used to provide an indication to the microprocessor of the spiral binder of when the spiral coil 28 has spiraled through all of the holes 17 in the stack of papers 12. As illustrated in FIG. 14, the sizing mechanism 184 includes the bearing blocks 188, the rotatably mounted shaft 186, the paper sizing slide 27, a lobed cam 210 and the on/off switch 214.

The shaft 186 is rotatably mounted within the bearing blocks 188 between the hold down comb 20 and the support channel 190. The paper sizing slide 27 is slidably mounted on the shaft 186. The paper sizing slide 27 is mounted on the shaft 186 so that it may slide along the length of the shaft as illustrated by arrow 212. However, the paper sizing slide 27 is mounted to the shaft 186 such that rotation of the paper sizing slide 27 causes a corresponding rotation of the shaft 186.

The lobed cam 210 is attached to the left end of the shaft 186. Rotation of the shaft 186 causes a corresponding rotation of the lobed cam 210. As best illustrated in FIGS. 13 and 14, the on/off switch 214 includes an actuator lever 180 and a microswitch 214. The actuator lever 180 is mounted on the inside wall of the side panel of the side panel 226. A portion of the actuator lever 180 extends upward and contacts the lobed cam 210. The microswitch 214 is also attached to the inside wall of the side panel 226 and is positioned so that the switch is in line with the upward extending portion of the actuator lever 180.

After the stack of papers 12 has been placed within the spiral binder 10 and the hold down comb 20 is in place, the operator slides the paper sizing slide 27 to the right as illustrated in FIG. 1 until it contacts the left edge of the stack of papers 12. As the spiral coil 28 completes its spiraling motion through the holes 17, the free end of the spiral coil exiting the left-most hole 17 contacts the rear edge 220 (FIG. 12) of the paper sizing slider 27. The spiraling motion of the spiral coil 28 pushes the rear edge of the paper sizing slider 27 upward thus rotating the shaft 186 clockwise as illustrated by arrow 222 (FIG. 14).

Clockwise rotation of the shaft 186 causes the lobed cam 210 to deform the actuator lever 180 outward as illustrated by arrow 224 in FIG. 13. This outward movement of the actuator lever 180 triggers the microswitch 214. Triggering the microswitch 214 in turn instructs the controller that the binding operation is complete. The controller then stops the coil feeder 32, triggers the coil cutter 134 and then raises the hold down comb 20 to its retracted position.

Figure 15:
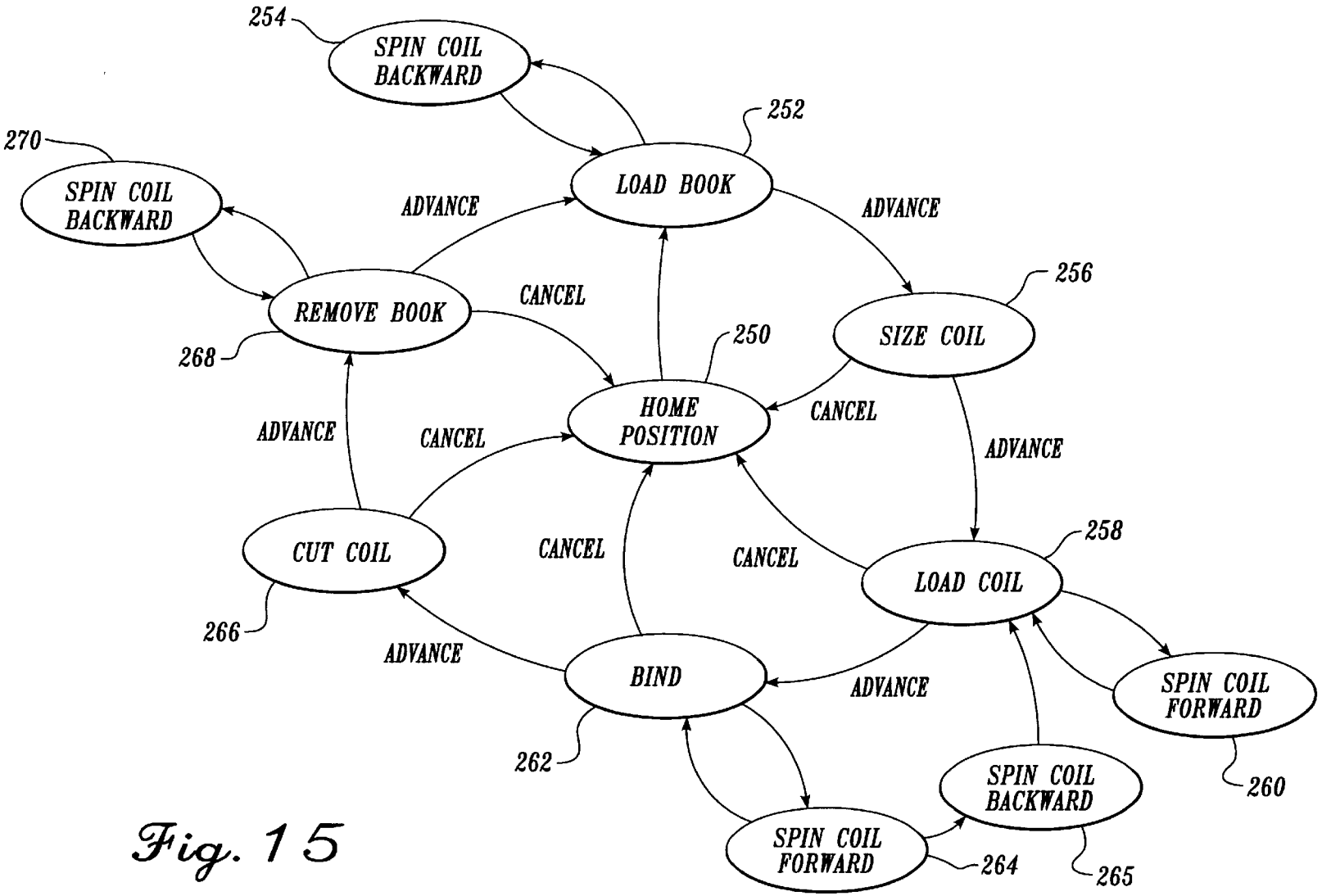
FIG. 15 is a state diagram illustrating the operation of the spiral binding apparatus of FIG. 1.

In order to fully understand the operation of the microprocessor and spiral binder 10, the state diagram of the preferred embodiment is illustrated in FIG. 15. After power up, the spiral binder 10 moves to its home position 250. In its home position, the hold down comb 20 is located in its retracted position and the locator pins 18 are in their extended position. The spiral binder 10 then provides the operator an indication that it is ready to load a stack of papers 12 or book for binding 252. If a short piece of spiral coil 28 is located within the coil feeder 32 such that it triggers third sensor 109 but not second sensor 105, the coil feeder spins the coil 28 backwards out of the coil feeder as shown by state 254.

The operator then places the stack of papers 12 to be bound over the locator pins 18 upon the binding platform 14. The operator then presses the advance button 34, which causes the spiral binder 10 to size the coil required as shown by state 256. The spiral binder 10 sizes the coil by lowering the paper hold down comb 20. As discussed above, once the paper hold down comb 20 is lowered the sensor 182 provides the controller an indication of the thickness of the stack of papers 12. This indication is used by the microprocessor to provide an indication of required coil size on the indicator 24.

After the coil is sized, the operator loads the coil (if there is not an adequate section of coil already inserted) as shown in state 258 by inserting it through the aperture 30. The spiral binder then spins the coil into position coil home 260. The spiral binder then binds the stack of papers 12 by first lowering the pins and then spiraling the coil through the holes 17 in the stack of papers 12 as shown in states 262 and 264. As the binder spirals the coil forward through the holes 17 in the paper, it continues to monitor the sensors 105 and 109. If a short piece of spiral coil 28 which would not be able to finish the binding job is being rolled through the coil feeder 32 such that it triggers third sensor 109 but not second sensor 105, the coil feeder 32 spins the coil backwards out of the holes 17 in the paper and out of the coil feeder 32 as shown by state 265, and then returns to state 258 for loading a new coil.

Spiraling continues until the end of the coil switch 214 is triggered and the spiral binder stops the coil feeder 32. The coil is then cut to length automatically as illustrated in state 266. The hold-down bar is retracted automatically and the bound book is then removed from the spiral binder as indicated in state 268. If the portion of the spiral coil 28 remaining within the coil feeder 32 triggers the third sensor 109 but not second sensor 105, the remaining portion of the coil 28 is again spun out of the coil feeder 32 as shown in state 270. Once the advance button 34 is depressed again, the operation of the spiral binder 10 starts over and advances to the load book position 252 by raising the locator pins. At any time during the binding operation, the operator may depress the cancel button 35, returning the spiral binder to the home position 250.

While the preferred embodiment of the invention has been illustrated and described, it will be appreciated that various changes can be made therein without departing from the spirit and scope of the invention. For example, the operation of the spiral binder could be automated upon insertion of the coil as opposed to depressing the advance button.

The embodiments of the invention in which an exclusive property or privilege is claimed are defined as follows:

1. A method of spiral binding a stack of papers, the method comprising:

placing a stack of papers having a plurality of holes along one edge within a spiral binding apparatus; and spiraling a coil into the holes in the stack of papers in a pulsed manner in which a rate of rotation at which the coil is spiraled into the holes in the stack of papers changes periodically.

2. The method of claim 1, further comprising:

placing the coil between a feed shaft and a rotatably mounted roller so that the coil contacts and moves between the feed shaft and the roller;

applying a biasing force to the roller that biases the roller into contact with the coil which in turn biases the coil into contact with the feed shaft; and rotating the roller, causing the coil to rotate and spiral around a plurality of guides that extend radially outward from the surface of the feed shaft.

3. The method of claim 1, further comprising positioning the stack of papers within the spiral binding apparatus upon a plurality of curved extendible and retractable locator pins that extend through the holes in the stack of papers.

4. The method of claim 3, further comprising rotatably retracting the locator pins out of the holes in the stack of papers after the stack of papers is properly positioned to allow the coil to be spiraled through the holes in the stack of papers.

5. An apparatus for spiral binding a stack of papers together as a unit, the apparatus comprising:

a coil feeder for rotatably feeding a preformed coil into a plurality of holes in the stack of papers, the coil feeder including:

a rotatably mounted roller;

a drive motor coupled to the roller to rotate the roller; and a drive motor controller connected to the drive motor to rotate the roller in a pulsed manner in which the rate of rotation at which the coil is rotatably fed into the holes in the stack of papers changes periodically, and;

a feed shaft spaced radially outward from the surface of the roller and positioned so that as the coil is fed into the coil feeder, onto the feed shaft, the coil contacts the roller and feed shaft and is rotated by the roller, wherein the roller applies a force on the coil to push the coil into contact with the feed shaft as the coil moves through the coil feeder.

6. The apparatus of claim 5, wherein the controller is a microprocessor which includes a program for operating the drive motor in a pulsed manner.

7. The apparatus of claim 5, wherein the controller causes the drive motor to operate with an initial inertia that rotates the motor an angular distance that is limited in part by a resistance of the roller and the coil as the coil is rotatably fed into the stack of papers.

8. The apparatus of claim 5, further comprising a plurality of guides extending radially outward from the surface of the feed shaft, the guides being positioned on the feed shaft so that the coil spirals around the guides as the coil is fed through the coil feeder, the guides having chamfered edges that assist the coil in spiraling around the guides as the coil is fed through the coil feeder.

9. The apparatus of claim 8, wherein the coil feeder is slidably and removably mounted within the apparatus.

10. The apparatus of claim 5, further comprising a coil spreader for spreading an end of the coil so as to guide the end of the coil into a first hole in the stack of papers.

11. The apparatus of claim 5, wherein the coil spreader includes a chamfered edge that spreads the end of the coil.

12. The apparatus of claim 5 further comprising a coil cutter, and wherein the coil cutter has a chamfered edge for assisting in guiding an end of the coil through the coil cutter.

13. The apparatus of claim 5, wherein the apparatus further comprises:

a plurality of locator pins that are movable from an extended position in which the locator pins extend through the holes in the stack of papers and position the stack of papers in the proper position for binding and a retracted position in which the pins move out of the holes in the stack of papers to allow the coil to be fed into the holes in the stack of papers;

a plurality of guide shafts to which the locator pins are slidably mounted for guiding the locator pins in their movement between the extended and retracted positions; and a plurality of floating mounts for mounting the guide shafts to the apparatus, the floating mounts allowing the guide shafts and thus the pins to shift slightly when papers are pressed against them in directions other than that in which they move between the extended and retracted positions.

14. The apparatus of claim 5, further comprising a plurality of curved locator pins that extend into the holes in the stack of papers to locate the stack of papers within the apparatus and that retract out of the holes in the stack of papers to allow the coil to be fed into the holes in the stack of papers.

15. The apparatus of claim 14, wherein the curved locator pins are rotatably extended into and retracted out of the holes in the stack of papers.

16. An apparatus for spiral binding a stack of papers together as a unit, the apparatus comprising:

a coil feeder for rotatably feeding a preformed coil into a plurality of holes in the stack of papers, the coil feeder comprising:

a rotatably mounted roller;

a drive motor to rotate the roller;

a feed shaft spaced radially outward from the surface of the roller and positioned so that as the coil is fed into the coil feeder, onto the feed shaft, the coil contacts the roller and feed shaft and is rotated by the roller, wherein the roller applies a force on the coil to push the coil into contact with the feed shaft as the coil moves through the coil feeder; and a plurality of guides extending radially outward from the surface of the feed shaft, the guides being positioned on the feed shaft so that the coil spirals around the guides as the coil is fed through the coil feeder, the guides having chamfered leading edges that help to guide the end of the coil as it is spiraled through the coil feeder.

17. The apparatus of claim 16, further comprising a coil spreader for spreading an end of the coil so as to guide the end of the coil into a first hole in the stack of papers, wherein the coil spreader includes a chamfered edge that spreads the end of the coil.

18. The apparatus of claim 16, further comprising a coil cutter that cuts the coil to size after the coil feeder binds the stack of papers, wherein the coil cutter has a chamfered edge for assisting in guiding an end of the coil through the coil cutter.

19. An apparatus for spiral binding a stack of papers together as a unit, the apparatus comprising:

a coil feeder for rotatably feeding a preformed coil into a plurality of holes in the stack of papers, and;

a plurality of curved locator pins that are movable from an extended position in which the locator pins extend through the holes in the stack of papers and position the stack of papers in the proper position for binding and a retracted position in which the pins move out of the holes in the stack of papers to allow the coil to be fed into the holes in the stack of papers.

20. The apparatus of claim 19, wherein the coil feeder further comprises:

a rotatably mounted roller;

a drive motor to rotate the roller; and a feed shaft spaced radially outward from the surface of the roller and positioned so that as the coil is fed into the coil feeder and onto the feed shaft, the coil contacts the roller and feed shaft and is rotated by the roller, and wherein the roller applies a force on the coil to push the coil into contact with the feed shaft as the coil moves through the coil feeder.

21. The apparatus of claim 19, wherein the curved locator pins are rotatably extended into and retracted out of the holes in the stack of papers.

22. An apparatus for spiral binding a stack of papers together as a unit, the apparatus comprising:

a coil feeder for rotatably feeding a preformed coil into a plurality of holes in the stack of papers, the coil feeder including:

a rotatably mounted roller;

a drive motor coupled to the roller to rotate the roller;

a feed shaft spaced radially outward from the surface of the roller and positioned so that as the coil is fed into the coil feeder, onto the shaft, the coil contacts the roller and feed shaft and is rotated by the roller, wherein the roller applies a force on the coil to push the coil into contact with the feed shaft as the coil moves through the coil feeder; and a plurality of guides extending radially outward from the surface of the feed shaft and positioned to guide the coil as the coil is spiraled through the coil feeder, wherein the guides and feed shaft are slidably and removably mounted in the apparatus.

23. An apparatus for spiral binding a stack of papers having holes that are spaced from one another along one edge of the stack of papers, the apparatus comprising:

coil drive means for receiving a preformed spiral coil that is inserted in the coil drive means and for rotating the preformed spiral coil to move it along an axial path that substantially corresponds with the axial center line of the preformed spiral coil;

a plurality of locator pins that are moveable between an extended position in which the locator pins extend through the holes in the stack of papers and position the stack of paper for binding and a retracted position in which the pins move out of the holes in the stack of papers to allow the preformed spiral coil to be fed through the holes;

hold-down means for holding the stack of papers in position for binding while the coil drive means moves the spiral coil along the axial path for insertion in the holes of the stack of papers; and a coil spreader mounted to receive a preformed spiral coil that is moved along the axial path by the drive means, the coil spreader receiving and spreading the end coil of a preformed spiral coil prior to insertion in the holes of the stack of paper so as to guide the end coil of the preformed spiral coil into the first hole in the stack of papers.

24. The apparatus of claim 23 wherein the coil spreader includes two spaced-apart walls having chamfered edges for guiding the end coil of the preformed spiral coil into the first hole of the stack of papers and for continuous guiding of the preformed spiral coil during insertion of the preformed spiral coil into the remaining holes of the stack of paper.

25. The apparatus of claim 24 wherein the coil spreader further includes a spreading wedge that extends between the spaced-apart walls of the coil spreader to contact and spread the preformed spiral coil by contacting adjacent turns of the coil.

26. The apparatus of claim 23 wherein the coil drive means comprises a coil feeder that includes a rotatably mounted roller, a drive motor to rotate the roller and a feed shaft spaced radially outward from the surface of the roller and positioned so that a preformed spiral coil that is inserted in the coil drive means is fed into the coil feeder, the feed shaft causing the coil to contact the roller and feed shaft so that the roller applies force to the coil to move it along the axial path that substantially corresponds with the axial centerline of the preformed spiral coil.

27. The apparatus of claim 26 wherein the coil feeder further includes a drive motor controller connected to the drive motor to rotate the roller in a pulsed manner to periodically change the rate of rotation at which the preformed spiral coil is driven along the axial path for insertion into the holes in the stack of papers.

28. The apparatus of claim 27 wherein the coil spreader includes two spaced-apart walls having chamfered edges for guiding the end coil of the preformed spiral coil into the first hole of the stack of papers and for continuous guiding of the preformed spiral coil during insertion of the preformed spiral coil into the remaining holes of the stack of paper.

29. The apparatus of claim 28 wherein the coil spreader further includes a spreading wedge that extends between the spaced-apart walls of the coil spreader to contact and spread the preformed spiral coil by contacting adjacent turns of the coil.

30. In a binding machine of the type in which a preformed spiral coil is driven along an axial path for insertion in a series of spaced-apart holes that are located along an edge of stacked sheets of paper that are positioned with the holes of the individual sheets of paper in alignment with one another, the improvement comprising:

a coil spreader for receiving and guiding the preformed spiral coil, the coil spreader being mounted along the axial path and being positioned adjacent the sheets of stacked paper, the coil spreader being dimensioned and arranged to spread the turn of the spiral coil that will next enter the first hole of the stacked papers as the coil is driven along the axial path.

31. The apparatus of claim 30 wherein the coil spreader includes a spreading wedge that spreads the turn of the preformed spiral coil that will next enter the holes of the stacked papers.

32. The apparatus of claim 30 wherein the coil spreader includes two spaced-apart walls having chamfered edges that contact the spiral coil to guide the end of the spiral coil during insertion of the preformed spiral coil into the first hole and during continued insertion of the coil in the remaining holes.

33. The apparatus of claim 32 wherein the coil spreader includes a spreading wedge that extends between the spaced-apart walls of the coil spreader to spread the turn of the preformed spiral coil that will next enter the holes of the stacked papers.

* * * * *